US010818484B2

(12) United States Patent
Nagata et al.

(10) Patent No.: US 10,818,484 B2
(45) **Date of Patent: *Oct. 27, 2020**

(54) MICROCHANNEL PLATE AND ELECTRON MULTIPLIER TUBE WITH IMPROVED GAIN AND SUPPRESSED DETERIORATION

(71) Applicant: HAMAMATSU PHOTONICS K.K., Hamamatsu-shi, Shizuoka (JP)

(72) Inventors: Takaaki Nagata, Hamamatsu (JP); Yasumasa Hamana, Hamamatsu (JP); Hajime Nishimura, Hamamatsu (JP); Daichi Masuko, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/489,004

(22) PCT Filed: Jan. 23, 2018

(86) PCT No.: PCT/JP2018/001984

§ 371 (c)(1),
(2) Date: Aug. 27, 2019

(87) PCT Pub. No.: WO2018/159159

PCT Pub. Date: Sep. 7, 2018

(65) Prior Publication Data

US 2020/0027709 A1 Jan. 23, 2020

(30) Foreign Application Priority Data

Mar. 1, 2017 (JP) ..... 2017-038463

(51) Int. Cl.
*H01J 43/24* (2006.01)

(52) U.S. Cl.
CPC ..... *H01J 43/246* (2013.01); *H01J 43/243* (2013.01); *H01J 2237/24435* (2013.01)

(58) Field of Classification Search
CPC ..... H01J 43/246; H01J 43/243; H01J 2237/24435
See application file for complete search history.

(56) References Cited

U.S. PATENT DOCUMENTS 4,568,853 A * 2/1986 Boutot ..... H01J 43/246 313/103 CM
8,052,884 B2 * 11/2011 Sullivan ..... H01J 43/246 216/25

(Continued)

FOREIGN PATENT DOCUMENTS

JP 2001-351509 A 12/2001
JP 2011-513921 A 4/2011

(Continued)

OTHER PUBLICATIONS

International Preliminary Report on Patentability dated Sep. 12, 2019 2019 for PCT/JP2018/001984.

(Continued)

*Primary Examiner* — Tracie Y Green
(74) *Attorney, Agent, or Firm* — Faegre Drinker Biddle & Reath LLP

(57) ABSTRACT

A microchannel plate is provided with a substrate including a front surface, a rear surface, and a side surface, a plurality of channels penetrating from the front surface to the rear surface of the substrate, a first film provided on at least an inner wall surface of the channel, a second film provided on at least a part of the first film, and electrode layers provided on the front surface and the rear surface of the substrate. The first film is made of MgO, the second film is made of $SiO_2$, and the second film is thinner than the first film.

26 Claims, 17 Drawing Sheets

(56) References Cited

U.S. PATENT DOCUMENTS

| | | | | |
|---|---|---|---|---|
| 9,064,677 | B2 * | 6/2015 | Uchiyama | H01J 43/246 |
| 9,117,640 | B2 * | 8/2015 | Uchiyama | H01J 43/04 |
| 10,340,129 | B2 * | 7/2019 | Nagata | H01J 43/24 |
| 2003/0173884 | A1 | 9/2003 | Heo et al. | |
| 2017/0352515 | A1 * | 12/2017 | Hosea | H01J 43/26 |

FOREIGN PATENT DOCUMENTS

| | | | |
|---|---|---|---|
| JP | 2017-50239 | A | 3/2017 |
| WO | WO-2009/148643 | A2 | 12/2009 |

OTHER PUBLICATIONS

Jokela, Slade J. et al., "Secondary electron yield of emissive materials for large-area micro-channel plate detectors: surface composition and film thickness dependencies," Physics Procedia 37 (2012) pp. 740-747.

* cited by examiner (a)

*Fig.12*

(atm%)

| | C | O | F | Mg | Si | Fe | MgO:$MgCO_3$ |
|---|---|---|---|---|---|---|---|
| ONLY MgO (COMPARATIVE EXAMPLE) | 45.8 | 35.7 | 1.3 | 17.2 | | | 57:43 |
| MgO+$SiO_2$ (DEPOSITION OF FIVE TIMES) (EXAMPLE 1) | 34.2 | 36.2 | 2.7 | 25 | 1.9 | | 86:14 |
| MgO+$SiO_2$ (DEPOSITION OF 10 TIMES) (EXAMPLE 2) | 22.7 | 45.3 | 2.4 | 22.1 | 6.5 | 1.1 | 87:13 |

(a)

(b)

MICROCHANNEL PLATE AND ELECTRON MULTIPLIER TUBE WITH IMPROVED GAIN AND SUPPRESSED DETERIORATION

TECHNICAL FIELD

One aspect of the present invention relates to a microchannel plate and an electron multiplier.

BACKGROUND ART

Conventionally, a microchannel plate provided with a substrate including a front surface and a rear surface and a plurality of channels penetrating from the front surface to the rear surface of the substrate is known (refer to, for example, Patent Document 1). In this microchannel plate, a first emission layer is formed in the channel and a second emission layer is formed on the first emission layer.

CITATION LIST

Patent Literature

Patent Document 1: Japanese Unexamined Patent Application Publication No. 2011-513921

SUMMARY OF INVENTION

Technical Problem

Generally, a microchannel plate is a device used in a vacuum tube such as an image intensifier or a photomultiplier tube. When handleability during manufacture and a transport environment to customers of the microchannel plate alone are taken into consideration, stability of a characteristic under an environment different from the environment of the vacuum tube is important for the microchannel plate. In the conventional technology described above, for example, in a case where the microchannel plate is exposed to the atmosphere, a surface of the second emission layer formed of an $Al_2O_3$ layer is contaminated or altered, and as a result, gain might be deteriorated over time. In the above-described conventional technology, since magnitude of secondary electron emission coefficients of the first emission layer and the second emission layer are not sufficiently taken into consideration in a configuration of the microchannel plate, for example, even if the secondary electron emission coefficient of the first emission layer is large, it is not possible to utilize a characteristic of the first emission layer and gain of the microchannel plate might be lowered.

An object of one aspect of the present invention is to provide a microchannel plate and an electron multiplier capable of improving the gain while suppressing deterioration in gain over time.

Solution to Problem

In order to solve the above-described problem, the inventors of the present invention exhaustively studied. As a result, the inventors of the present invention found that the deterioration in gain over time during the time of exposure to the atmosphere, for example, may be suppressed by providing a first film made of MgO (magnesium oxide) on an inner wall surface of a channel and providing a second film made of $SiO_2$ (silicon dioxide) on at least a part of the first film. In addition, the inventors of the present invention found that it is possible to utilize a characteristic of MgO having a large secondary electron emission coefficient to efficiently improve the gain by making the second film made of $SiO_2$ thinner than the first film made of MgO. Furthermore, the inventors found that the gain increases from initial gain immediately before exposure to the atmosphere after the exposure to the atmosphere when the first film is made of MgO and the second film is made of $SiO_2$, and achieved the present invention.

A microchannel plate according to one aspect of the present invention is provided with a substrate including a front surface, a rear surface, and a side surface, a plurality of channels penetrating from the front surface to the rear surface of the substrate, a first film provided on at least an inner wall surface of the channel, a second film provided on at least a part of the first film, and electrode layers provided on the front surface and the rear surface of the substrate, in which the first film is made of MgO, the second film is made of $SiO_2$, and the second film is thinner than the first film.

In the microchannel plate, since the second film made of $SiO_2$ is provided on at least a part of the first film made of MgO, it is possible to suppress deterioration in gain over time during the time of the exposure to the atmosphere, for example. In addition, since the second film made of $SiO_2$ is made thinner than the first film made of MgO, it is possible to allow the first film made of MgO to serve as a main secondary electron multiplier layer while utilizing a characteristic of MgO having a large secondary electron emission coefficient, thereby efficiently improving the gain. Furthermore, since the first film is made of MgO and the second film is made of $SiO_2$, the gain may be increased from the initial gain after the exposure to the atmosphere. Therefore, it is possible to improve the gain while suppressing the deterioration in gain over time.

In the microchannel plate according to one aspect of the present invention, the second film may be distributed in an island shape on the first film. In this case, it is possible to further improve the gain by allowing the first film to more effectively serve as the secondary electron multiplier layer while sufficiently securing the effect of suppressing the deterioration in gain over time.

In the microchannel plate according to one aspect of the present invention, a thickness of the first film may be 10 Å or more when being calculated using X-ray fluorescence analysis. If the first film made of MgO has the thickness of 10 Å or more in this manner, the first film may be allowed to effectively serve as the secondary electron multiplier layer.

In the microchannel plate according to one aspect of the present invention, the substrate may be made of an insulating material, and a resistance film may be formed between the inner wall surface of the channel and the first film. In this case, a potential gradient is formed by the resistance film when voltage is applied between the electrode layer provided on the front surface of the substrate and the electrode layer provided on the rear surface of the substrate, and electron multiplication becomes possible.

In the microchannel plate according to one aspect of the present invention, the substrate may be made of a resistant material. In this case, it is unnecessary to provide the resistance film on the inner wall surface of the channel, and a manufacturing process of the resistance film may be omitted, so that a manufacturing cost may be reduced.

In the microchannel plate according to one aspect of the present invention, the first film and the second film may be formed on the front surface, the rear surface, and the side surface of the substrate, and the electrode layers may be formed on the second film. Alternatively, the electrode layers may be formed so as to be in contact with the front surface and the rear surface of the substrate, and the first film and the second film may be formed on the electrode layers, and the front surface, the rear surface, and the side surface of the substrate. In these configurations, gas emission from the substrate may be effectively suppressed in a case where the substrate is made of a material which emits a large amount of gas, for example, since the first film and the second film cover the front surface, the rear surface, and the side surface of the substrate.

In the microchannel plate according to one aspect of the present invention, the resistance film, the first film, and the second film may be formed on the front surface, the rear surface, and the side surface of the substrate, and the electrode layers may be formed on the second film. Alternatively, the electrode layers may be formed so as to be in contact with the front surface and the rear surface of the substrate, and the resistance film, the first film, and the second film may be formed on the front surface, the rear surface, and the side surface of the substrate. In these configurations, gas emission from the substrate may be effectively suppressed in a case where the substrate is made of a material which emits a large amount of gas, for example, since not only the first film and the second film but also the resistance film cover the front surface, the rear surface, and the side surface of the substrate.

In the microchannel plate according to one aspect of the present invention, the first film and the second film may be layers formed by atomic layer deposition. In this case, since the first film and the second film may be formed at an atomic layer level, a film in which a defect such as a pinhole is suppressed with a uniform film quality may be formed.

An electron multiplier according to one aspect of the present invention is provided with a main body including a front surface, a rear surface, and a side surface, a channel penetrating from the front surface to the rear surface of the main body, a first film provided on at least an inner wall surface of the channel, a second film provided on at least a part of the first film, and electrode layers provided on the front surface and the rear surface of the main body, in which the first film is made of MgO, the second film is made of $SiO_2$, and the second film is thinner than the first film.

In the electron multiplier, since the second film made of $SiO_2$ is provided on at least a part of the first film made of MgO, it is possible to suppress deterioration in gain over time during the time of exposure to the atmosphere, for example. In addition, since the second film made of $SiO_2$ is made thinner than the first film made of MgO, it is possible to allow the first film made of MgO to serve as a main secondary electron multiplier layer while utilizing a characteristic of MgO having a large secondary electron emission coefficient, thereby efficiently improving the gain. Furthermore, since the first film is made of MgO and the second film is made of $SiO_2$, the gain may be increased from the initial gain after the exposure to the atmosphere. Therefore, it is possible to improve the gain while suppressing the deterioration in gain over time.

In the electron multiplier according to one aspect of the present invention, the second film may be distributed in an island shape on the first film. In this case, it is possible to further improve the gain by allowing the first film to more effectively serve as the secondary electron multiplier layer while sufficiently securing the effect of suppressing the deterioration in gain over time.

In the electron multiplier according to one aspect of the present invention, a thickness of the first film may be 10 Å or more when being calculated by using X-ray fluorescence analysis. If the first film has the thickness of 10 Å or more in this manner, the first film made of MgO may be allowed to effectively serve as the secondary electron multiplier layer.

In the electron multiplier according to one aspect of the present invention, the main body may be made of an insulating material, and a resistance film may be formed between the inner wall surface of the channel and the first film. In this case, a potential gradient is formed by the resistance film when voltage is applied between the electrode layer provided on the front surface of the main body and the electrode layer provided on the rear surface of the main body, and electron multiplication becomes possible.

In the electron multiplier according to one aspect of the present invention, the main body may be made of a resistant material. In this case, it is unnecessary to provide the resistance film on the inner wall surface of the channel, and a manufacturing process of the resistance film may be omitted, so that a manufacturing cost may be reduced.

In the electron multiplier according to one aspect of the present invention, the first film and the second film may be formed on the front surface, the rear surface, and the side surface of the main body, and the electrode layers may be formed on the second film. Alternatively, the electrode layers may be formed so as to be in contact with the front surface and the rear surface of the main body, and the first film and the second film may be formed on the electrode layers, and the front surface, the rear surface, and the side surface of the main body. In these configurations, gas emission from the main body may be effectively suppressed in a case where the main body is made of a material which emits a large amount of gas, for example, since the first film and the second film cover the front surface, the rear surface, and the side surface of the main body.

In the electron multiplier according to one aspect of the present invention, the resistance film, the first film, and the second film may be formed on the front surface, the rear surface, and the side surface of the main body, and the electrode layers may be formed on the second film. Alternatively, the electrode layers may be formed so as to be in contact with the front surface and the rear surface of the main body, and the resistance film, the first film, and the second film may be formed on the front surface, the rear surface, and the side surface of the main body. In these configurations, gas emission from the main body may be effectively suppressed in a case where the main body is made of a material which emits a large amount of gas, for example, since not only the first film and the second film but also the resistance film cover the front surface, the rear surface, and the side surface of the main body.

In the electron multiplier according to one aspect of the present invention, the first film and the second film may be layers formed by atomic layer deposition. In this case, since the first film and the second film may be formed at an atomic layer level, a film in which a defect such as a pinhole is suppressed with a uniform film quality may be formed.

In the microchannel plate according to one aspect of the present invention, the resistance film may be formed by laminating an $Al_2O_3$layer and a Pt layer alternately. In the microchannel plate according to one aspect of the present invention, the first film may be formed on an $Al_2O_3$layer.

In the microchannel plate according to one aspect of the present invention, the first film may be formed on a Pt layer.

In the electron multiplier according to one aspect of the present invention, the resistance film may be formed by laminating an $Al_2O_3$layer and a Pt layer alternately. In the electron multiplier according to one aspect of the present invention, the first film may be formed on an $Al_2O_3$layer.

In the electron multiplier according to one aspect of the present invention, the first film may be formed on a Pt layer.

Effects of Invention

According to one aspect of the present invention, it is possible to provide a microchannel plate and an electron multiplier capable of improving the gain while suppressing deterioration in gain over time.

BRIEF DESCRIPTION OF DRAWINGS

FIG. 1(*b*) is a perspective view illustrating a film configuration of the microchannel plate of FIG. 1(*a*).

FIG. 4(*b*) is a side view illustrating distribution of $SiO_2$ in FIG. 4(*a*).

FIG. 4(*c*) is a perspective view illustrating the distribution of $SiO_2$ in FIG. 4(*a*).

FIG. 5(*b*) is a side view illustrating distribution of $SiO_2$ in FIG. 5(*a*).

FIG. 5(*c*) is a perspective view illustrating the distribution of $SiO_2$ in FIG. 5(*a*).

FIG. 6(*b*) is a side view illustrating distribution of $SiO_2$ in FIG. 6(*a*).

FIG. 6(*c*) is a perspective view illustrating the distribution of $SiO_2$ in FIG. 6(*a*).

FIG. 8(*b*) is a view schematically illustrating a bonding structure of the outermost surface of MgO on which $SiO_2$ is deposited.

FIG. 12 is a view illustrating a change in composition of a film due to exposure in the atmosphere.

FIG. 17(*b*) is a cross-sectional view of an electron multiplier according to the variation.

DESCRIPTION OF EMBODIMENTS

Hereinafter, embodiments according to one aspect of the present invention are described in detail with reference to the accompanying drawings. In the description of the drawings, the same reference sign is assigned to the same or corresponding elements and the description is not repeated.

First Embodiment

Figure 1:
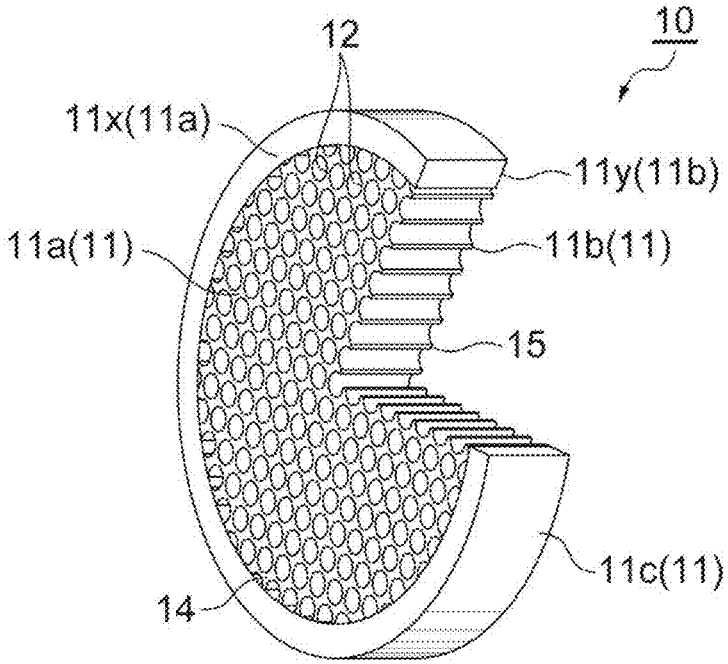
FIG. 1(*a*) is a perspective view of a microchannel plate according to a first embodiment.
Figure 1:
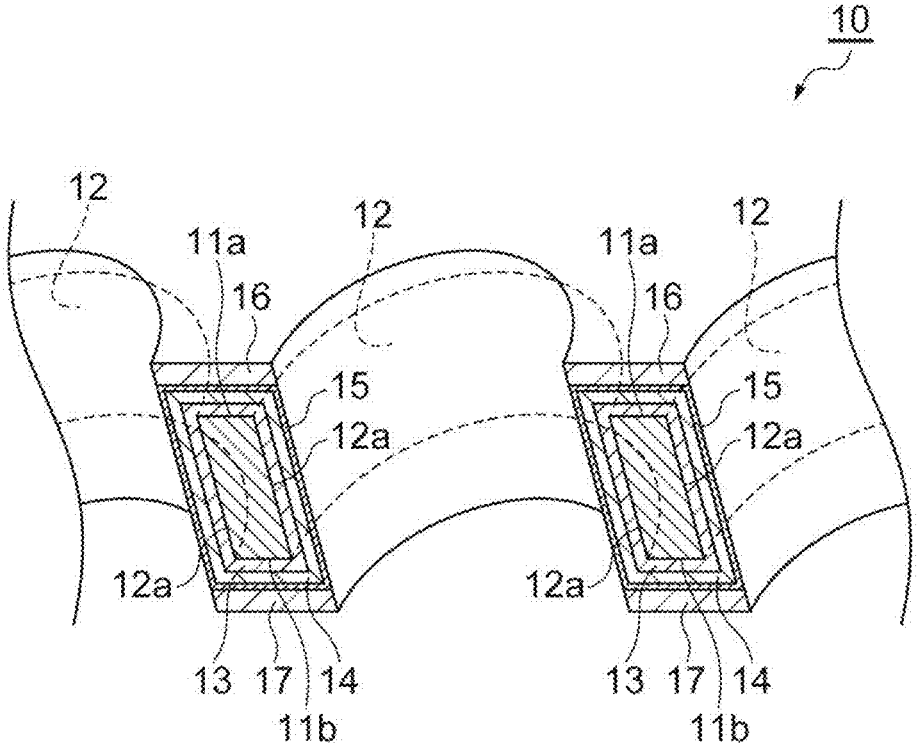

FIG. 1(*a*) is a perspective view of a microchannel plate according to a first embodiment. FIG. 1 illustrates the microchannel plate with a cross-section of a part thereof. As illustrated in FIG. 1(*a*), a microchannel plate 10 is a member having a function of multiplying electrons. The microchannel plate 10 includes a disc-shaped substrate 11 including an input surface (front surface) 11*a* and an output surface (rear surface) 11*b*. The substrate 11 is made of an insulating material such as soda-lime glass, borosilicate glass, lead glass, an aluminum oxide treated with alumite treatment or the like, for example. A plurality of channels 12 each having a circular cross-section is formed in the substrate 11. The channel 12 penetrates from the input surface 11*a* to the output surface 11*b* of the substrate 11. The channels 12 are arranged in a matrix pattern in a plan view such that a center-to-center distance between adjacent channels 12 is, for example, several micrometers to tens of micrometers. A length of the channel 12 in a thickness direction of the microchannel plate 10 is, for example, 430 μm. A diameter of the channel 12 is, for example, 10 μm.

FIG. 1(*b*) is a perspective view illustrating a film configuration of the microchannel plate of FIG. 1(*a*). FIG. 1(*b*) illustrates the film configuration of a cross-section in the thickness direction in the microchannel plate 10. As illustrated in FIG. 1(*b*), a resistance film 13, an electron emission film (first film) 14, a protection film (second film) 15, an input electrode (electrode layer) 16, and an output electrode (electrode layer) 17 are formed on the substrate 11 as functional films.

The resistance film 13 is provided on an inner wall surface 12*a* of the channel 12. The resistance film 13 is provided so as to cover an outer surface of the substrate 11. Specifically, the resistance film 13 is formed on at least the inner wall surface 12*a* of the channel 12. The resistance film 13 is formed on the input surface 11*a* including an edge 11*x* where the channel 12 is not formed. The resistance film 13 is formed on the output surface 11*b* including an edge 11*y* where the channel 12 is not formed. The edges 11*x* and 11*y* are provided, for example, for convenience of handling of the microchannel plate 10.

In the cross-section illustrated in FIG. 1(*b*), the resistance film 13 is formed into a rectangular frame shape surrounding the substrate 11. The resistance film 13 is formed so as to cover a side surface 11*c* of the substrate 11. The resistance film 13 covers the input surface 11*a*, the output surface 11*b*, the inner wall surface 12*a* of the channel 12, and the side surface 11*c* in the above-described manner, so that gas emission from the substrate 11 may be effectively suppressed in a case where the substrate 11 is made of the material such as lead glass which emits a large amount of gas during operation, for example. The resistance film has a predetermined resistance value suitable for electron multiplication in the microchannel plate 10.

The resistance film 13 is formed by using, for example, the atomic layer deposition (ALD). The resistance film 13 is formed, for example, by repeating a cycle of depositing an $Al_2O_3$ layer and a cycle of depositing a Pt layer by the atomic layer deposition a plurality of times, respectively. A thickness of the resistance film 13 is, for example, about 200 Å to 700 Å.

The atomic layer deposition is a method of repeatedly performing an adsorption process of a molecule of a compound, a film formation process by reaction, and a purge process of removing a surplus molecule, thereby depositing (laminating) atomic layers one by one to obtain a thin film. As a material for forming the electron emission film 14 and the protection film 15, a metal oxide is used from a viewpoint of obtaining chemical stability. Examples of such metal oxide include $Al_2O_3$, MgO, BeO, CaO, SrO, BaO, $SiO_2$, $TiO_2$, RuO, ZrO, NiO, CuO, GaO, ZnO and the like, for example. According to the atomic layer deposition, since the film is formed at an atomic layer level, a film in which a defect such as a pinhole is suppressed with a uniform film quality may be formed. A mixed film containing a plurality of metal oxides may be formed in the order of angstroms. The mixed film containing a plurality of metal oxides may be formed, for example, for a gap and a trench structure with a high aspect ratio.

The electron emission film 14 is the first film provided on the inner wall surface 12*a* of the channel 12. The electron emission film 14 is provided so as to cover the resistance film 13. Specifically, the electron emission film 14 is formed so as to be in contact with the resistance film 13 on at least the inner wall surface 12*a* of the channel 12. The electron emission film 14 is formed so as to be in contact with the resistance film 13 on the input surface 11*a* including the edge 11*x* where the channel 12 is not formed. The electron emission film 14 is formed so as to be in contact with the resistance film 13 on the output surface 11*b* including the edge 11*y* where the channel 12 is not formed. The electron emission film 14 is formed into a rectangular frame shape so as to surround the resistance film 13 on the cross-section illustrated in FIG. 1(*b*). The electron emission film 14 is formed so as to cover the side surface 110 of the substrate 11. The electron emission film 14 covers the input surface 11*a*, the output surface 11*b*, the inner wall surface 12*a* of the channel 12, and the side surface 11*c* in the above-described manner, so that the gas emission from the substrate 11 may be effectively suppressed in a case where the substrate 11 is made of the material such as lead glass which emits a large amount of gas during operation, for example. When electrons accelerated by an electric field (to be described later) in the channel 12 collide with the electron emission film 14, the electron emission film 14 emits secondary electrons accordingly and multiplies the electrons.

The electron emission film 14 is made of MgO. The electron emission film 14 is formed by using the atomic layer deposition, for example. The electron emission film 14 is formed, for example, by repeating a cycle of depositing all MgO layer by the atomic layer deposition a plurality of times. In a case of forming the electron emission film 14, $Mg(Cp)_2$ may be used, for example, as reaction gas. In this case, a process of forming the electron emission film 14 includes an $H_2O$ adsorption process, an $H_2O$ purge process, a $Mg(Cp)_2$ adsorption process, and a $Mg(Cp)_2$ purge process. In the process of forming the electron emission film 14, a series of processes is repeatedly performed until a desired thickness of the electron emission film 14 is realized.

The thickness of the electron emission film 14 is 10 Å or more. The "thickness of the film" is herein intended to mean a value corresponding to a film thickness calculated on the basis of a signal value regarding presence of an element contained in the film obtained by analyzing the film by using X-ray fluorescence analysis (XRF) (thickness calculated by using the X-ray fluorescence analysis). That is, the thickness of the electron emission film 14 is 10 Å or more in a case where the thickness of the electron emission film 14 is calculated by using the X-ray fluorescence analysis. More preferably, the thickness of the electron emission film 14 is, for example, about 30 Å to 100 Å.

The protection film 15 is the second film provided on at least a part of the electron emission film 14 (first film). The protection film 15 is formed so as to be in contact with the electron emission film 14 on at least a part of the inner wall surface 12*a* of the channel 12. The protection film 15 is formed so as to be in contact with the electron emission film 14 on at least a part of the input surface 11*a*. The protection film 15 is formed so as to be in contact with the electron emission film 14 on at least a part of the output surface 11*b*. The protection film 15 is formed so as to be in contact with at least a part of the side surface 11*c* of the substrate 11. The protection film 15 is formed in at least a part of an area in a rectangular frame shape surrounding the electron emission film 14 in the cross-section illustrated in FIG. 1(*b*). The protection film 15 suppresses deterioration in gain (gain) over time of secondary electron emission when the microchannel plate 10 is exposed to the atmosphere, and increases the gain from initial gain in cooperation with the electron emission film 14 (to be described later in detail). The gain is an index indicating a degree of emission of the secondary electrons in a state in which the film is formed on the channel, for example.

The protection film 15 is made of $SiO_2$. The protection film 15 is formed by using the atomic layer deposition, for example. The protection film 15 is formed, for example, by repeating a cycle of depositing a $SiO_2$ layer by the atomic layer deposition a plurality of times. A thickness of the protection film 15 is, for example, a half or less of that of the electron emission film 14. Preferably, the thickness of the protection film 15 is, for example, 10 Å or less. More preferably, the thickness of the protection film 15 is, for example, about 5 Å to 10 Å. That is, the protection film 15 is thinner than the electron emission film 14.

The input electrode 16 and the output electrode 17 are provided on the input surface 11*a* and the output surface 11*b* of the substrate 11, respectively. Specifically, the input electrode 16 is formed so as to be in contact with the protection film 15 on the input surface 11*a* except for the edge 11*x*. The output electrode 17 is formed so as to be in contact with the protection film 15 on the output surface 11*b* except for the edge 11*y*. The input electrode 16 and the output electrode 17 are formed by evaporating an ITO film made of $In_2O_3$ and $SnO_2$, a nesa ($SnO_2$) film, a nichrome film, an Inconel (registered trademark) film or the like, for example. By using evaporation, the input electrode 16 is formed on the input surface 11*a* except for an opening of the channel 12, and the output electrode 17 is formed on the output surface 11*b* except for the opening of the channel 12. Thicknesses of the input electrode 16 and the output electrode 17 are, for example, about 1000 Å. Voltage potential which is lower in the output electrode 17 than in the input electrode 16 is applied to the input electrode 16 and the output electrode 17 such that an electric field directed from the input electrode 16 to the output electrode 17 is generated in the channel 12.

Herein, in order to specify structures or characteristics of the resistance film 13, the electron emission film 14, and the protection film 15 (hereinafter referred to as "ALD film" in this paragraph) formed by the atomic layer deposition, a surface state of the ALD film is necessarily analyzed. However, regarding the ALD film formed on a structure with a high aspect ratio such as the microchannel plate 10, no device capable of specifically analyzing the surface state thereof is currently known. Therefore, it is difficult to analyze a laminated structure itself of the ALD film. As described above, it is technically impossible or impractical to analyze the structure or the characteristic of the ALD film at the time of filing, so that there is a circumstance that it is impossible or impractical to directly specify the ALD film by its structure or characteristic in the microchannel plate 10.

Next, a method of manufacturing the microchannel plate 10 is described in detail.

Figure 2:
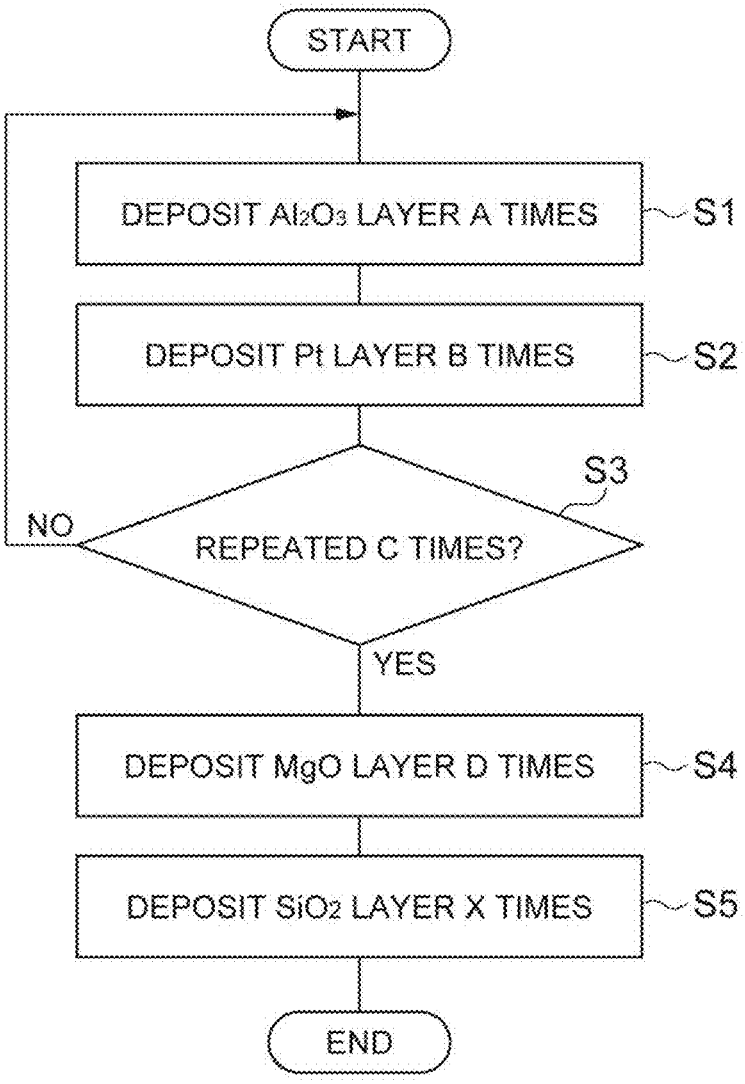
FIG. 2 is a flowchart illustrating a film forming process of the microchannel plate of FIG. 1.

FIG. 2 is a flowchart illustrating a film forming process of the microchannel plate of FIG. 1(*a*). First, the resistance film 13 is formed on the substrate 11 at steps S1 to S3. Specifically, as illustrated in FIG. 2, a cycle of depositing the $Al_2O_3$ layer by using the atomic layer deposition is repeated A times (step S1). Subsequently, a cycle of depositing the Pt layer is repeated B times (step S2). Steps S1 and S2 are repeated C times (step S3).

Figure 3:
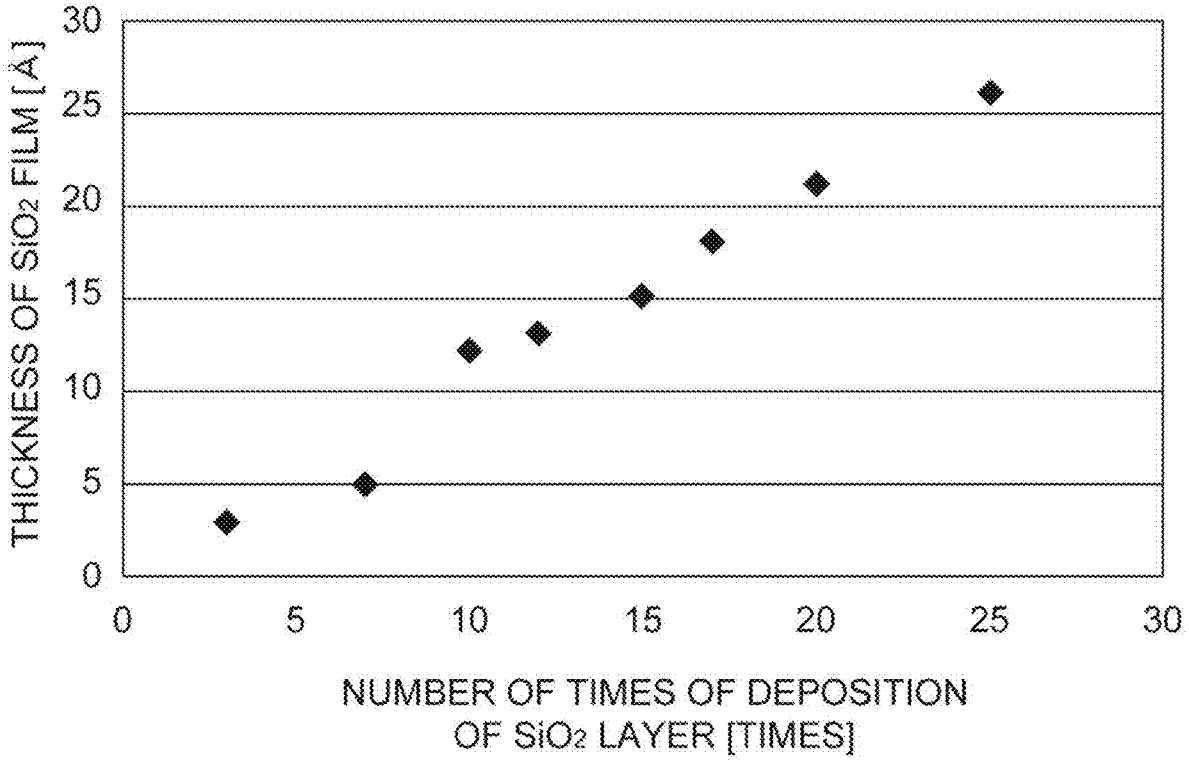
FIG. 3 is a view illustrating a relationship between the number of times of deposition of a $SiO_2$ layer and a layer thickness of $SiO_2$.

Subsequently, the electron emission film 14 is formed at step S4, and thereafter, the protection film 15 is formed on at least a part of the electron emission film 14 at step S5. Specifically, a cycle of depositing the MgO layer by using the atomic layer deposition is repeated D times (step S4). A cycle of depositing the $SiO_2$ layer on an outermost surface of MgO by using the atomic layer deposition is repeated X times (step S5). As illustrated in FIG. 3, in a case by using the atomic layer deposition, as the number of times of deposition of the $SiO_2$ layer at the time of forming a $SiO_2$ film increases, a thickness of the $SiO_2$ film (thickness calculated by using the X-ray fluorescence analysis) increases. Herein, as the number of times of deposition of the $SiO_2$ layer increases by one, the thickness of the $SiO_2$ film increases by approximately 1 Å. That is, one deposition (one cycle) of the $SiO_2$ layer corresponds to the thickness of the $SiO_2$ film of 1 Å. In this manner, it is possible to make the thickness of the $SiO_2$ film a desired thickness by changing the number of times of deposition of the $SiO_2$ layer. "Number of times of deposition" means the number of times the cycle of depositing a layer of film forming material is repeated by using the atomic layer deposition.

Figure 17:
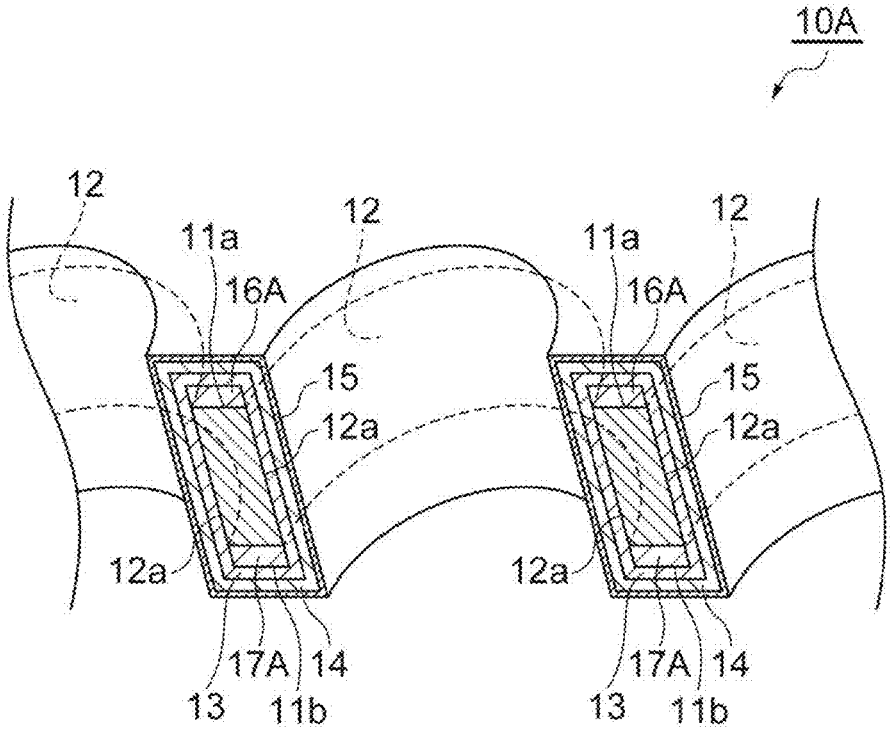
FIG. 17(*a*) is a cross-sectional view of a microchannel plate according to a variation.
Figure 17:
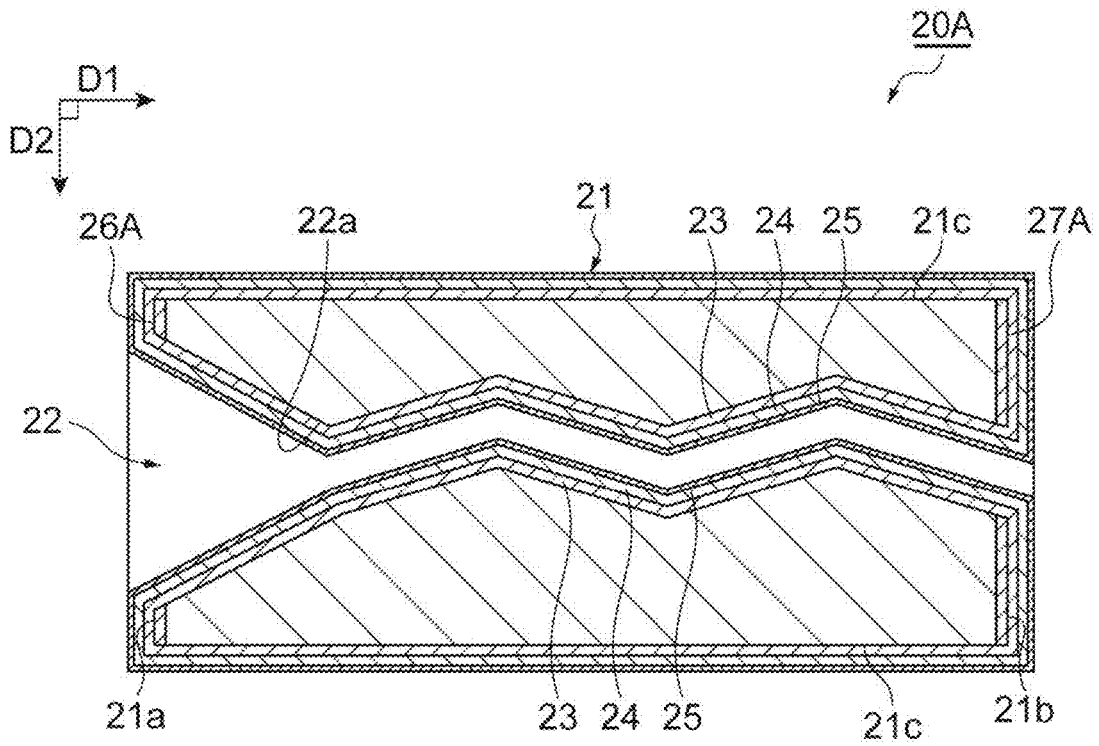

Subsequently, the input electrode 16 and the output electrode 17 are formed by evaporation and the like. Thereafter, for example, heat treatment and the like are performed to obtain the microchannel plate 10. Meanwhile, it is also possible to manufacture a microchannel plate 10A by forming the resistance film 13, the electron emission film 14, and the protection film 15 at steps S1 to S5 described above after forming an input electrode 16A and an output electrode 17A on the substrate 11 in advance by evaporation and the like (refer to FIG. 17(*a*)). In this case, the input electrode 16A is formed so as to be in contact with the input surface 11*a* of the substrate 11 and the output electrode 17A is formed so as to be in contact with the output surface 11*b*, and the resistance film 13, the electron emission film 14, and the protection film 15 are sequentially formed so as to cover the input electrode 16A and the output electrode 17A. A range in which the resistance film 13, the electron emission film 14, and the protection film 15 are formed is as described above, the range which covers the input surface 11*a*, the output surface 11*b*, the inner wall surface 12*a* of the channel 12, and the side surface 11*c*.

In the microchannel plate 10, by providing the protection film 15 made of $SiO_2$ on at least a part of the electron emission film 14 made of MgO, not only the deterioration in gain over time in a case of the exposure to the atmosphere is suppressed but also the gain increases from the initial gain immediately before the exposure to the atmosphere after the exposure to the atmosphere.

A structure of the protection film 15 is described in more detail. The protection film 15 is distributed in an island shape (island shape) on the electron emission film 14. Herein, a state "distributed in an island shape" includes a state in which $SiO_2$ forming the protection film 15 is scattered (discretely adsorbed) on MgO forming the electron emission film 14. The state "distributed in an island shape" includes a state in which the structure of the protection film 15 is a deposited structure in which a plurality of islands is formed on the outermost surface of MgO in a side view. The state "distributed in an island shape" includes a state in which $SiO_2$ forming the protection film 15 is partially absent on MgO forming the electron emission film 14. The state "distributed in an island shape" includes a state in which the structure of the protection film 15 is partially opened. The state "distributed in an island shape" includes a state in which $SiO_2$ forming the protection film 15 is entirely absent on MgO forming the electron emission film 14. The state "distributed in an island shape" includes a state in which the structure of the protection film 15 is not a continuous layer. The "continuous layer" of the protection film 15 refers to a structure in which the structure of the protection film 15 is not opened and covers an entire (entire surface of) the electron emission film 14.

Figure 4:
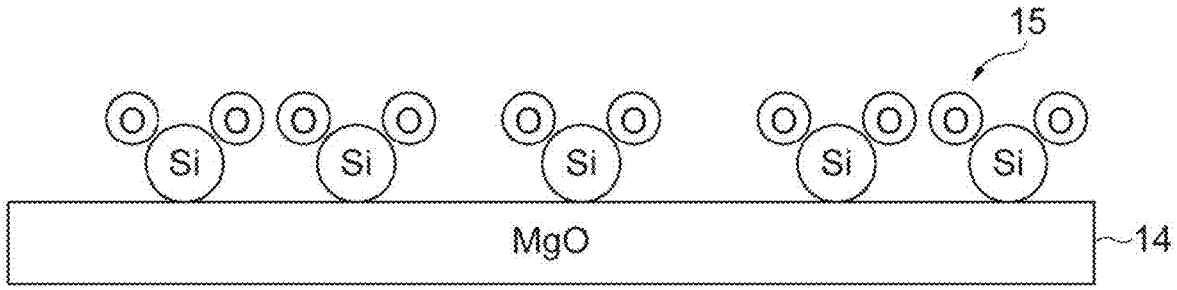
FIG. 4(*a*) is a side view conceptually illustrating a structure in which $SiO_2$ is deposited on an outermost surface of MgO.
Figure 4:
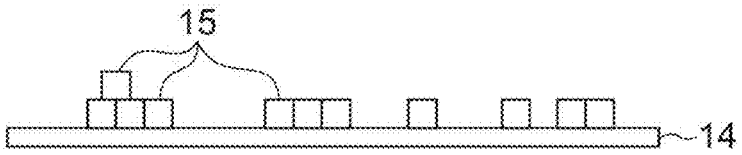
Figure 4:
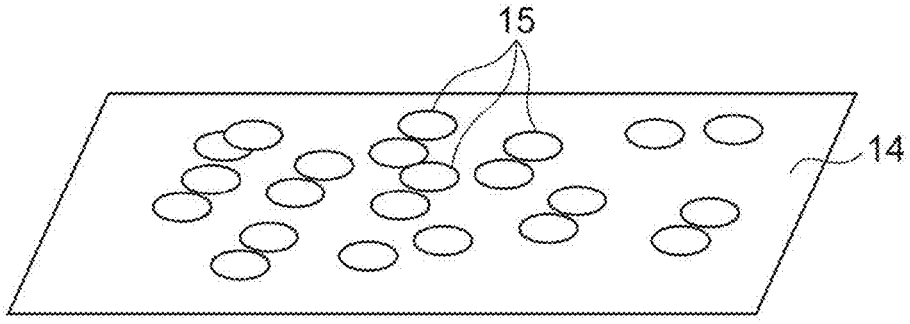

When the cycle of depositing $SiO_2$ on the outermost surface of MgO is carried out, first, as illustrated in FIG. 4(*a*), $SiO_2$ is adsorbed to MgO so that $SiO_2$ is scattered on the outermost surface of MgO. As a result, as illustrated in FIG. 4(*b*), on the protection film 15, a gap for exposing the outermost surface of MgO is formed, and the structure of the protection film 15 is partially opened. That is, as illustrated in FIG. 4(*c*), the protection film 15 is distributed in a sparse island shape on the electron emission film 14.

Figure 5:
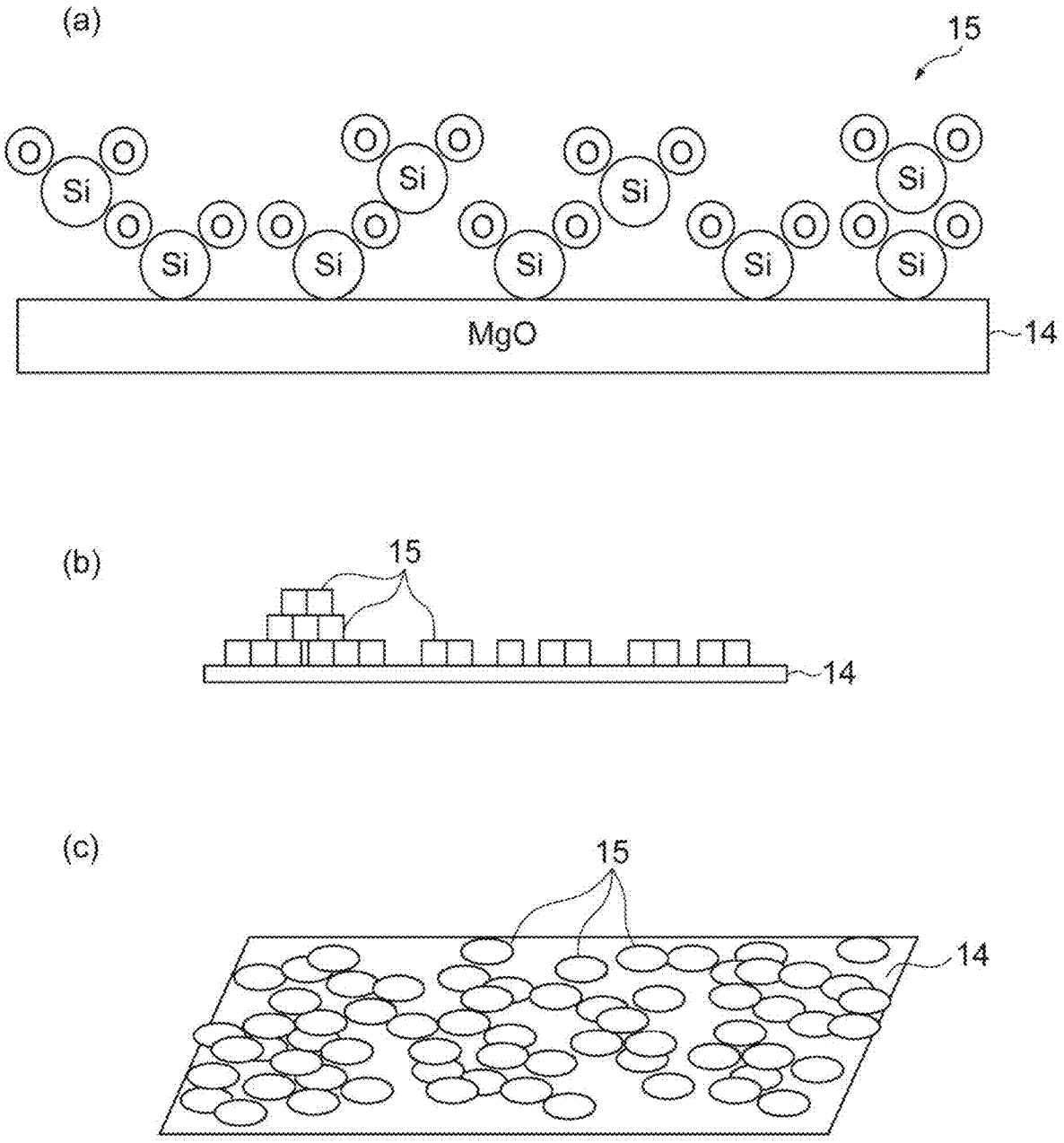
FIG. 5(*a*) is a side view conceptually illustrating a structure in which $SiO_2$ is further deposited on the outermost surface of MgO of FIG. 4.

Subsequently, when the cycle of depositing $SiO_2$ on the outermost surface of MgO in FIG. 4 is further carried out, as illustrated in FIG. 5(*a*), $SiO_2$ is further adsorbed to $SiO_2$ already absorbed to the outermost surface of MgO. This increases a thickness of $SiO_2$ adsorbed to the outermost surface of MgO. In addition, $SiO_2$ is newly adsorbed to the outermost surface of MgO to which $SiO_2$ is not adsorbed yet. As a result, as illustrated in FIG. 5(*b*), the gap for exposing the outermost surface of MgO becomes narrower than that in the example in FIG. 4(*b*), and a part of the holes of the protection film 15 is filled. That is, as illustrated in FIG. 5(*c*), the protection film 15 is distributed in a denser island shape than that in the example in FIG. 4(*c*) on the electron emission film 14.

Figure 6:
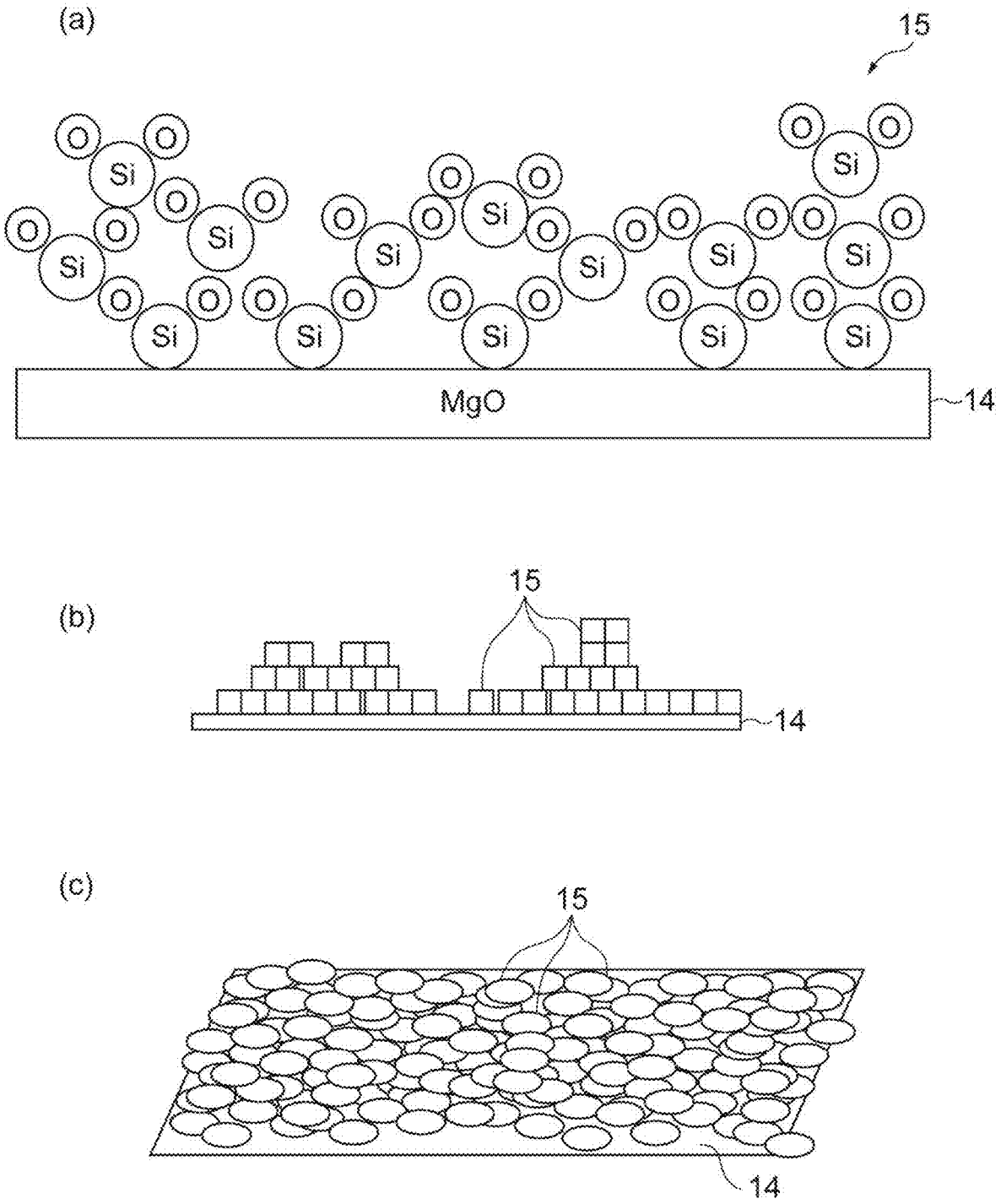
FIG. 6(*a*) is a side view conceptually illustrating a structure in which $SiO_2$ is further deposited on the outermost surface of MgO of FIG. 5.

Subsequently, when the cycle of depositing $SiO_2$ on the outermost surface of MgO in FIG. 5 is further carried out, as illustrated in FIG. 6(*a*), $SiO_2$ is further adsorbed to $SiO_2$ already absorbed to the outermost surface of MgO. This further increases the thickness of $SiO_2$ adsorbed to the outermost surface of MgO. In addition, $SiO_2$ is newly adsorbed to the outermost surface of MgO to which $SiO_2$ is not adsorbed yet. As a result, as illustrated in FIG. 6(*b*), the gap for exposing the outermost surface of MgO becomes narrower than that in the example in FIG. 5(*b*), and a part of the holes of the protection film 15 is further filled. That is, as illustrated in FIG. 6(*c*), the protection film 15 is distributed in a denser island shape than that in the example in FIG. 5(*c*) on the electron emission film 14 and approaches the continuous layer.

Figure 7:
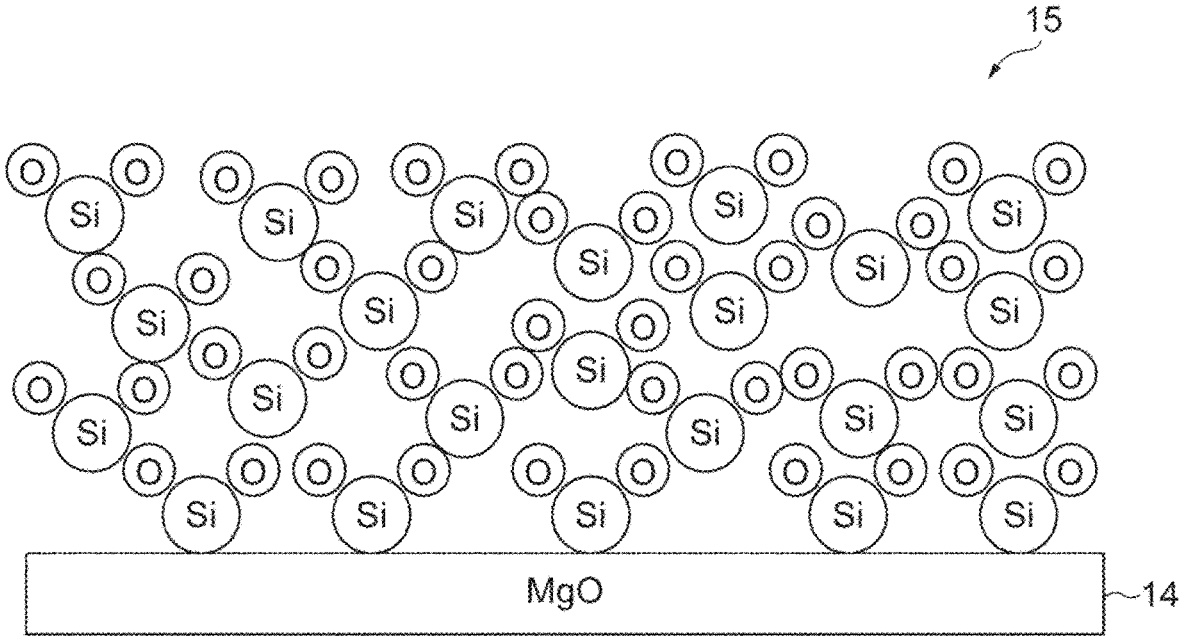
FIG. 7 is a side view conceptually illustrating a structure in which $SiO_2$ is further deposited on the outermost surface of MgO of FIG. 6.

Subsequently, when the cycle of depositing $SiO_2$ on the outermost surface of MgO in FIG. 6 is further carried out, as illustrated in FIG. 7, $SiO_2$ is further adsorbed to $SiO_2$ covering the outermost surface of MgO and $SiO_2$ is newly absorbed to the outermost surface of MgO to which $SiO_2$ is not yet absorbed. As a result, the protection film 15 is distributed in the continuous layer on the electron emission film 14.

In this manner, by changing the number of times of deposition of the $SiO_2$layer, it is possible to make the thickness of the $SiO_2$ film a desired thickness while allowing the protection film 15 to be distributed in an island shape on the electron emission film 14.

Meanwhile, the protection film 15 may be provided to cover the entire electron emission film 14 and may be distributed in a continuous layer. In this case, the protection film 15 is formed so as to be in contact with the electron emission film 14 on the inner wall surface 12*a* of the channel 12. The protection film 15 is formed so as to be in contact with the electron emission film 14 on the input surface 11*a*. The protection film 15 is formed so as to be in contact with the electron emission film 14 on the output surface 11*b*. The protection film 15 is formed so as to cover the side surface 11*c* of the substrate 11. The protection film 15 is formed into the rectangular frame shape so as to surround the electron emission film 14 in the cross-section illustrated in FIG. 1(*b*).

Figure 8:
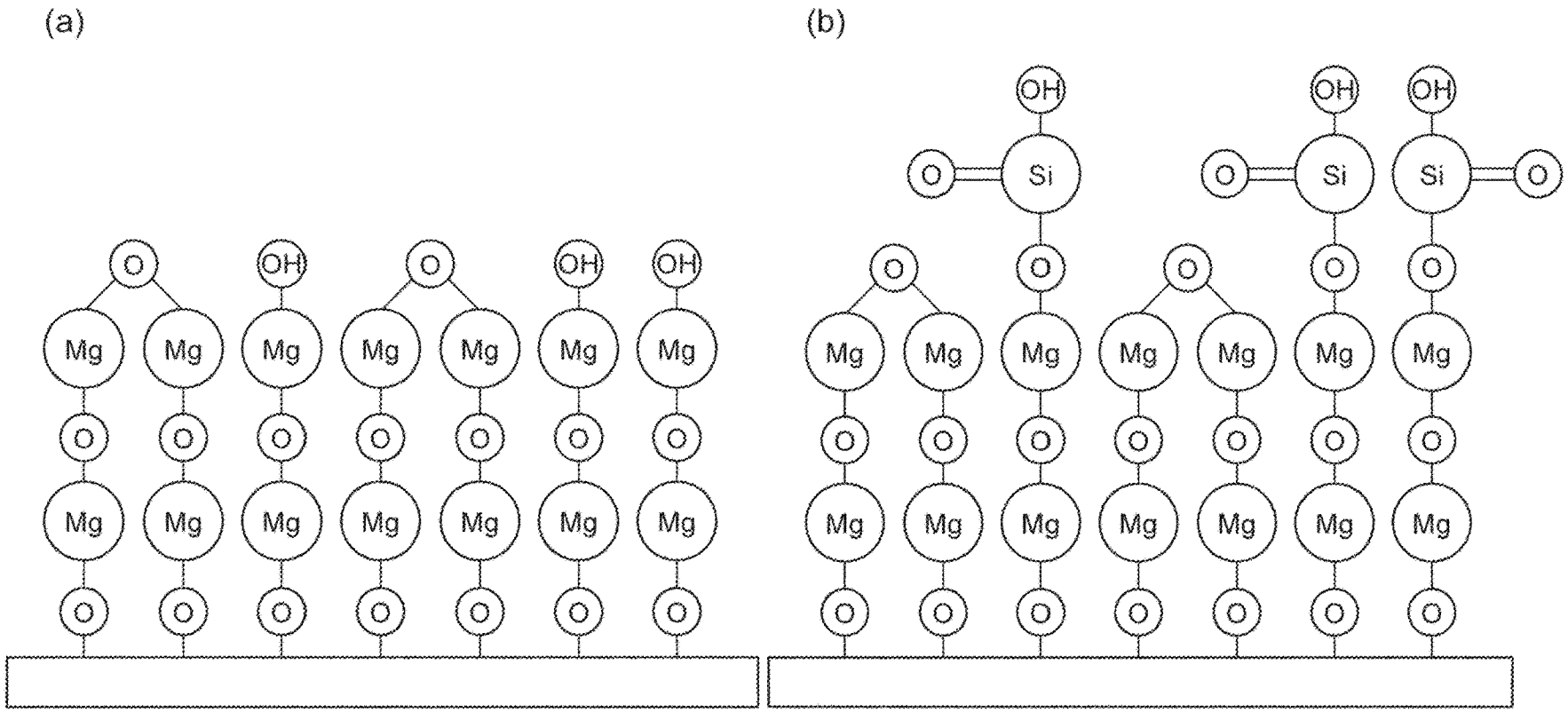
FIG. 8(*a*) is a view schematically illustrating a bonding structure of the outermost surface of MgO on which $SiO_2$ is not deposited.

FIG. 8(*a*) is a view schematically illustrating a bonding structure of the outermost surface of MgO on which $SiO_2$ is not deposited. FIG. 8(*b*) is a view schematically illustrating a bonding structure of the outermost surface of MgO on which $SiO_2$ is deposited. As illustrated in FIG. 8(*a*), on the outermost surface of MgO on which $SiO_2$ is not deposited, there is a bonding structure (reactive site) in which an OH group is bonded to Mg. At the reactive site, $H_2O$ (moisture), $CO_2$ (carbon dioxide) and the like present in the atmosphere react with MgO to easily generate $MgCO_3$. That is, when the protection film 15 made of $SiO_2$ is not provided on the electron emission film 14 made of MgO, C (carbon) derived from $H_2O$ and $CO_2$ present in the atmosphere is likely to be adhered to the outermost surface of MgO. In this point, MgO on which $SiO_2$ is not deposited is unstable in the atmosphere.

On the other hand, as illustrated in FIG. 8(*b*), no reactive site exists on the outermost surface of MgO on which $SiO_2$ is deposited. More specifically, the OH group is bonded to Mg via $SiO_2$ in place of the bonding structure in which the OH group is directly bonded to Mg. As a result, at a terminal end of the bonding structure on the outermost surface of MgO, it is suppressed that the OH group is directly bonded to Mg to become the reactive site. In other words, there is an end cap structure in which the reactive site is blocked. According to the end cap structure, reaction between $H_2O$ and $CO_2$ present in the atmosphere with MgO is suppressed and $MgCO_3$ is less likely to be generated as compared to a case where $SiO_2$ is not deposited on the outermost surface of MgO. That is, when the protection film 15 made of $SiO_2$ is provided on at least a part of the electron emission film 14 made of MgO, C (carbon) derived from $H_2O$ and $CO_2$ present in the atmosphere is not likely to be adhered to the outermost surface of MgO. In this respect, $SiO_2$ is stable in the atmosphere. In this manner, by allowing the $SiO_2$ layer stable in the atmosphere to absorb to the outermost surface of MgO susceptible to be unstable in the atmosphere, MgO may be stabilized even in the atmosphere.

Next, a characteristic of the gain of the microchannel plate 10 is described.

In the following description, as an example, the microchannel plate 10 manufactured by forming the protection film 15 by depositing the $SiO_2$ layer X times (5, 10, and 20 times) on the electron emission film 14 formed by depositing the MgO layer D times (30 times) in the method of manufacturing the microchannel plate 10 illustrated in FIG. 2 was prepared. Also, a microchannel plate in which no $SiO_2$ film is formed on the electron emission film 14 was prepared. The microchannel plates 10 obtained by depositing the $SiO_2$ layer X times (5, 10, and 20 times) are made examples 1, 2, and 3, respectively. The microchannel plate in which the $SiO_2$ film is not formed on the electron emission film 14 is made a comparative example.

First, a characteristic of the initial gain of the microchannel plate 10 is described. The initial gain is the gain immediately before the microchannel plate 10 is exposed to the atmosphere after being stored in $N_2$ until the gain becomes stable after the manufacture thereof.

Figure 9:
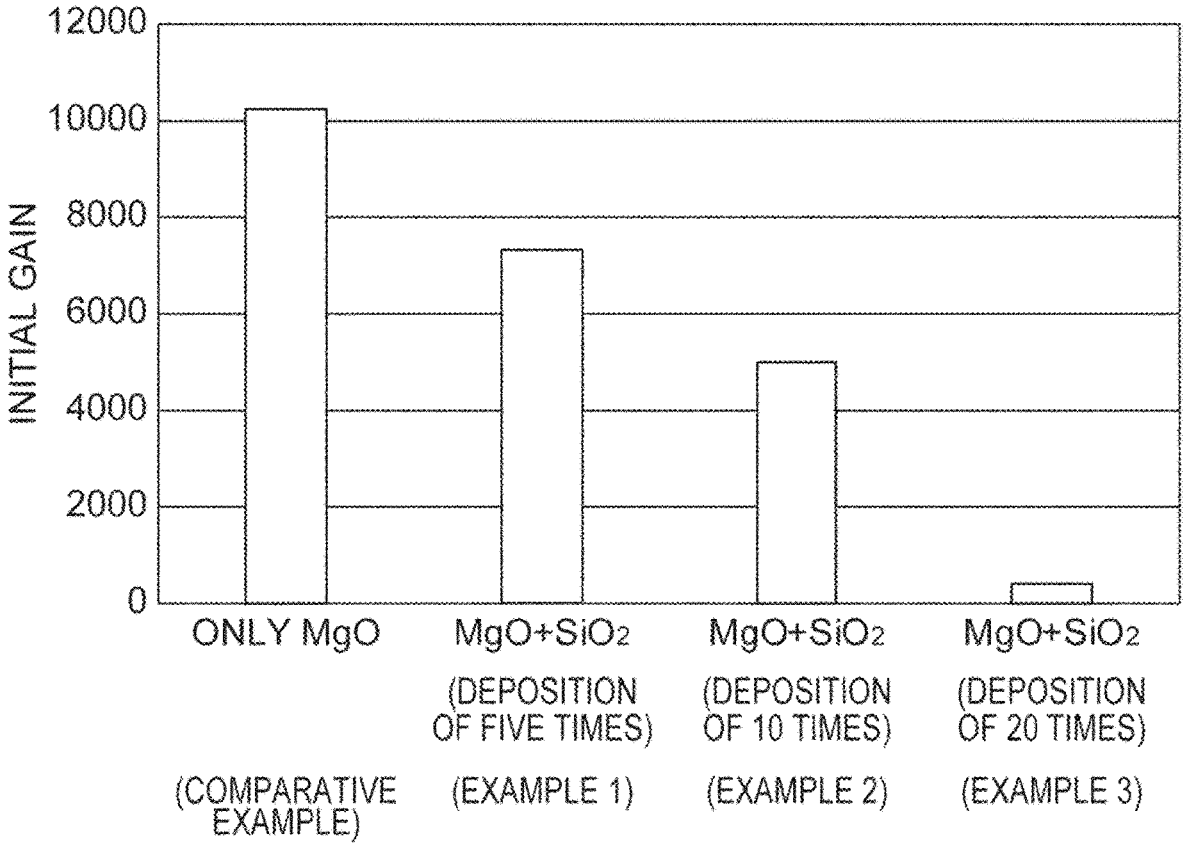
FIG. 9 is a graph illustrating a relationship of initial gain with respect to the number of times of deposition of the $SiO_2$ layer.

FIG. 9 is a graph illustrating a relationship of the initial gain with respect to the number of times of deposition of the $SiO_2$ layer. As illustrated in FIG. 9, the initial gain when the protection film 15 is formed on the electron emission film 14 (examples 1, 2, and 3) decreases as the number of times of deposition of the $SiO_2$ layer increases as compared to the initial gain in a case where the protection film 15 is not formed on the electron emission film 14 (comparative example). Meanwhile, in FIGS. 9 and 12 to 15, the representation "only MgO" means the microchannel plate in which the protection film 15 made of $SiO_2$ is not provided on the electron emission film 14 made of MgO (that is, the microchannel plate of only the electron emission film 14 made of MgO). The representation "MgO+$SiO_2$ (deposition of n times)" means the microchannel plate in which the protection film 15 made of the $SiO_2$ layer with the number of times of deposition of "n" is provided on at least a part of the electron emission film 14 made of MgO.

This decreasing tendency of the initial gain is considered in consideration of magnitude of secondary electron emission coefficients of the electron emission film 14 and the protection film 15. Meanwhile, in the following description, the secondary electron emission coefficient is an index indicating a degree of emission of the secondary electrons when focusing on the film itself.

The initial gain increases or decreases according to the secondary electrons emitted from the electron emission film 14 made of MgO and the secondary electrons emitted from the protection film 15 made of $SiO_2$. Herein, it was examined whether the protection film 15 made of $SiO_2$ serves as an electron emission film which emits the secondary electrons. A microchannel plate of the following reference example was used in this examination.

Figure 10:
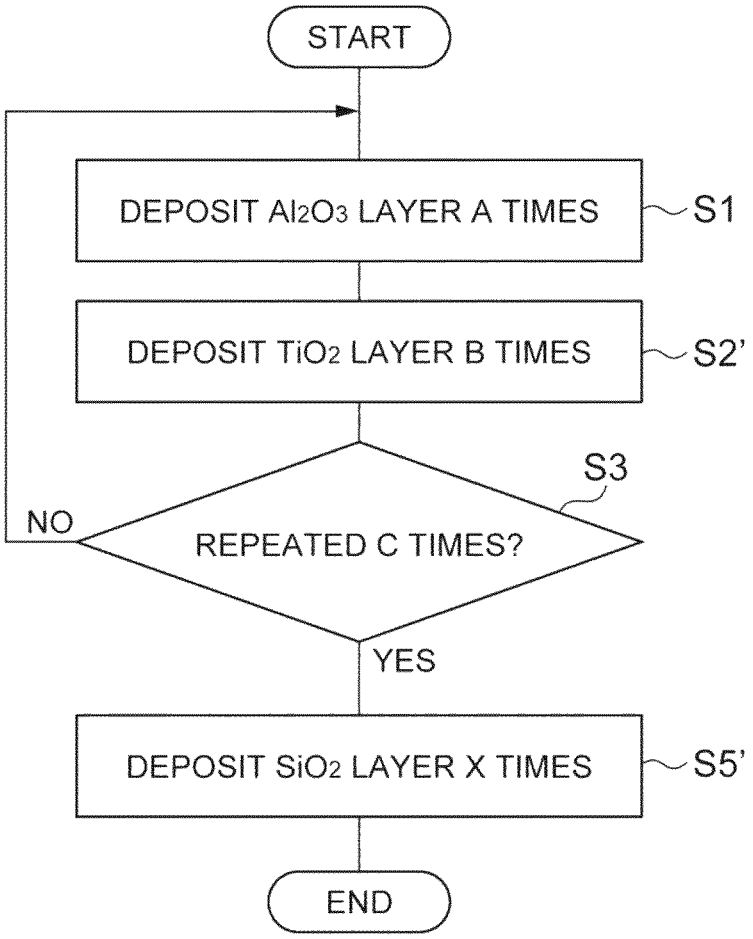
FIG. 10 is a flowchart illustrating a film forming process of a microchannel plate of a reference example.

FIG. 10 is a flowchart illustrating a film forming process of the microchannel plate of the reference example. In the microchannel plate of the reference example, only a protection film is formed on a substrate 11 on which a resistance film is formed without forming an electron emission film. As illustrated in FIG. 10, a cycle of depositing an $Al_2O_3$ layer by using the atomic layer deposition is repeated A times as at step S1 of the film forming process illustrated in FIG. 2. Subsequently, in place of step S2 of depositing a Pt layer in FIG. 2, a cycle of depositing a $TiO_2$ layer by using the atomic layer deposition was repeated B times (step S2').

Steps S1 and S2' are repeated C times (step S3). Subsequently, step S4 in the film forming process illustrated in FIG. 2 is skipped, and the protection film was formed on the $TiO_2$ layer by depositing the $SiO_2$ layer X times (3, 5, 7, 10, 12, 15, 17,25, and 34 times) without forming the MgO layer (step S5').

Figure 11:
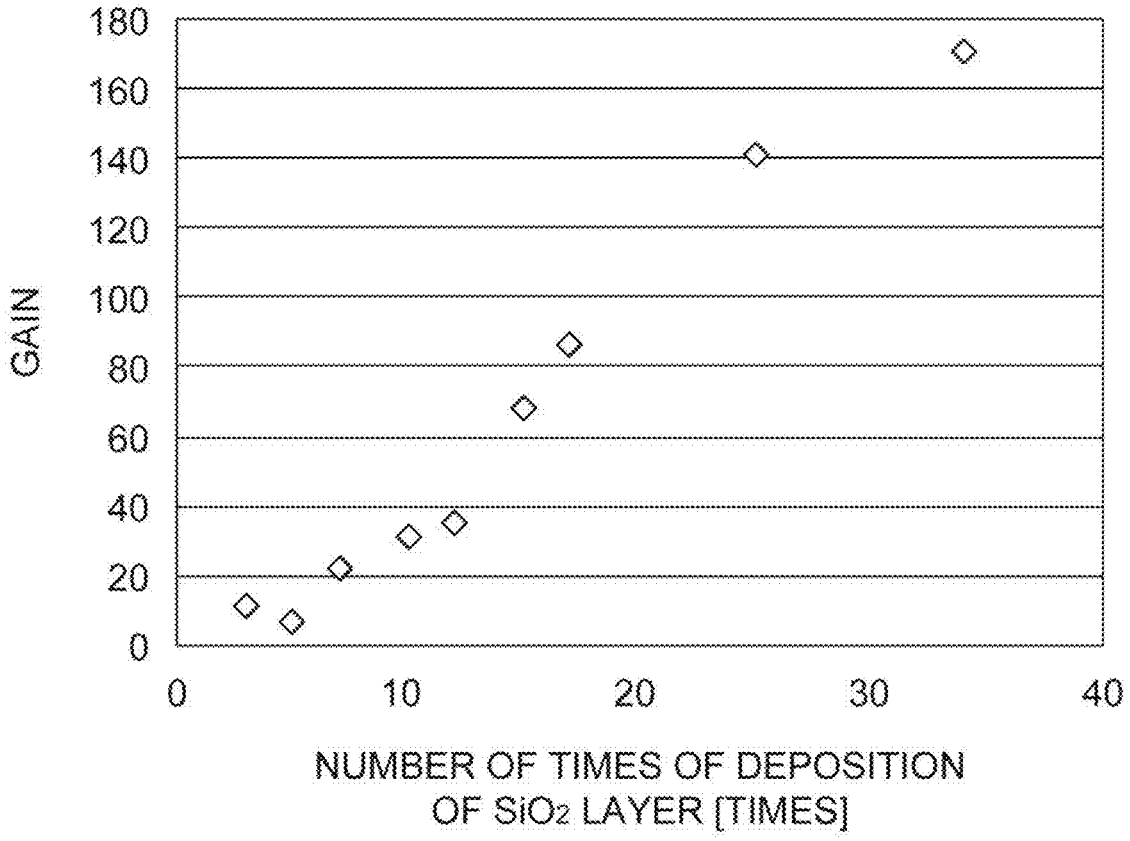
FIG. 11 is a view illustrating a relationship between the number of times of deposition of a $SiO_2$ layer and gain by this $SiO_2$.

FIG. 11 is a view illustrating a relationship between the number of times of deposition of the $SiO_2$ layer and gain by the $SiO_2$ layer in the microchannel plate of the reference example. In FIG. 11, the gain of the microchannel plate of the reference example is plotted along the ordinate. As illustrated in FIG. 11, it may be understood that the gain of the $SiO_2$ layer tends to increase as the number of times of deposition of the $SiO_2$ layer increases (as the thickness of the protection film increases).

However, the gain of this $SiO_2$ layer is smaller than the gain of the MgO layer. As an example of the gain of the MgO layer, the initial gain of the microchannel plate of the comparative example is about 10000 (refer to FIG. 9), whereas the magnitude of the gain of the $SiO_2$ layer is about 100 even in a case where the number of times of deposition of the $SiO_2$ layer is 20. Therefore, it is understood that, in the microchannel plate 10, the electron emission film 14 made of MgO serves as a main secondary electron multiplier layer. In this manner, in the microchannel plate 10, contribution of the protection film 15 made of $SiO_2$ to the secondary electron multiplication is smaller than the contribution of the electron emission film 14 made of MgO to the secondary electron multiplication. It may also be said that the protection film 15 serves as an electron non-emission film which does not substantially emit the secondary electrons.

According to the above-described consideration, in the microchannel plate 10, an effect is easily exhibited as the thickness of the protection film 15 increases, wherein the effect is that the emission of the secondary electrons from the electron emission film 14 is blocked by the protection film 15 which does not substantially emit the secondary electrons. Therefore, in the example of FIG. 9, it is considered that the initial gain decreases as the thickness of the protection film 15 increases.

Therefore, in the microchannel plate 10, it is considered that the characteristic of MgO having a large secondary electron emission coefficient may be utilized and the gain may be efficiently improved when the protection film 15 is made thin (for example, less than 10 Å) and the electron emission film 14 made of MgO is allowed to serve as the main secondary electron multiplier layer as compared to a case where the protection film 15 is made thicker (for example, 10 Å or more) and the secondary electron emission coefficient of the protection film 15 is increased. Therefore, in the microchannel plate 10, the thickness of the protection film 15 may be less than 10 Å. Especially, in the microchannel plate 10, the thickness of the protection film 15 may be 5 Å to 10 Å. By optimizing the thickness of the $SiO_2$ layer to be adsorbed in this manner, the electron emission film 14 made of MgO may be allowed to effectively serve as the secondary electron multiplier layer to maintain the high gain while sufficiently securing the effect of suppressing the deterioration in gain over time.

Next, a changing characteristic over time of the gain when the microchannel plate 10 is exposed to the atmosphere is described.

FIG. 12 is a view illustrating a change in composition of the film due to the exposure to the atmosphere. FIG. 12 illustrates a result of analyzing the change in composition of the film when the electron emission film 14 made of MgO and the protection film 15 made of $SiO_2$ are exposed to the atmosphere by X-ray photoelectron spectroscopy (XPS). The X-ray photoelectron spectroscopy is a technology of obtaining elemental composition and elemental bonding information of an area near a surface of a measurement target by detecting an energy spectrum of photoelectrons excited and emitted when X-rays are allowed to be incident on the measurement target. Herein, X-ray photoelectron spectroscopy was performed by using μ-XPS (μ-ESCA) as an X-ray photoelectron spectrometer, setting a depth of an area to be analyzed to the outermost layer (0 to several nm), using Al-Ka (1486.6 eV) as an X-ray source, setting a tube voltage to 15 kV, and setting an output to 400 W. Meanwhile, in the example of FIG. 12, in order to simplify the experiment, a predetermined metal plate was used in place of the substrate 11, and the electron emission film 14 made of MgO and the protection film 15 made of $SiO_2$ were formed on this metal plate.

As illustrated in FIG. 12, when the protection film 15 made of $SiO_2$ is not provided on the electron emission film 14 made of MgO, a ratio of $MgO:MgCO_3$ after the exposure to the atmosphere was 57:43. That is, it is inferred that C (carbon) derived from $H_2O$ and $CO_2$ present in the atmosphere adheres to the outermost surface of MgO. As described above, it is considered that this is because there is the bonding structure (reactive site) in which the OH group is bonded to Mg on the outermost surface of MgO.

On the other hand, in a case where the protection film 15 made of $SiO_2$ is provided on at least a part of the electron emission film 14 made of MgO, the ratio of $MgO:MgCO_3$ after the exposure to the atmosphere is 86:14 when the number of times of deposition of the $SiO_2$ layer is five, and 87:13 when the number of times of deposition of the $SiO_2$ layer is ten. That is, the adhesion of C derived from $H_2O$ and $CO_2$ present in the atmosphere to the outermost surface of MgO is suppressed. This is because, as described above, the OH group is bonded to Mg via $SiO_2$ in place of the bonding structure in which the OH group is directly bonded to Mg and the end cap structure in which the reactive site is blocked is realized. From the above results, in the microchannel plate 10, the protection film 15 made of $SiO_2$ is provided on at least a part of the electron emission film 14 made of MgO, so that the electron emission film 14 made of MgO which serves as the main secondary electron multiplier layer is allowed to be stabilized even in the atmosphere and the deterioration in gain over time during the time of the exposure to the atmosphere is suppressed.

Figure 13:
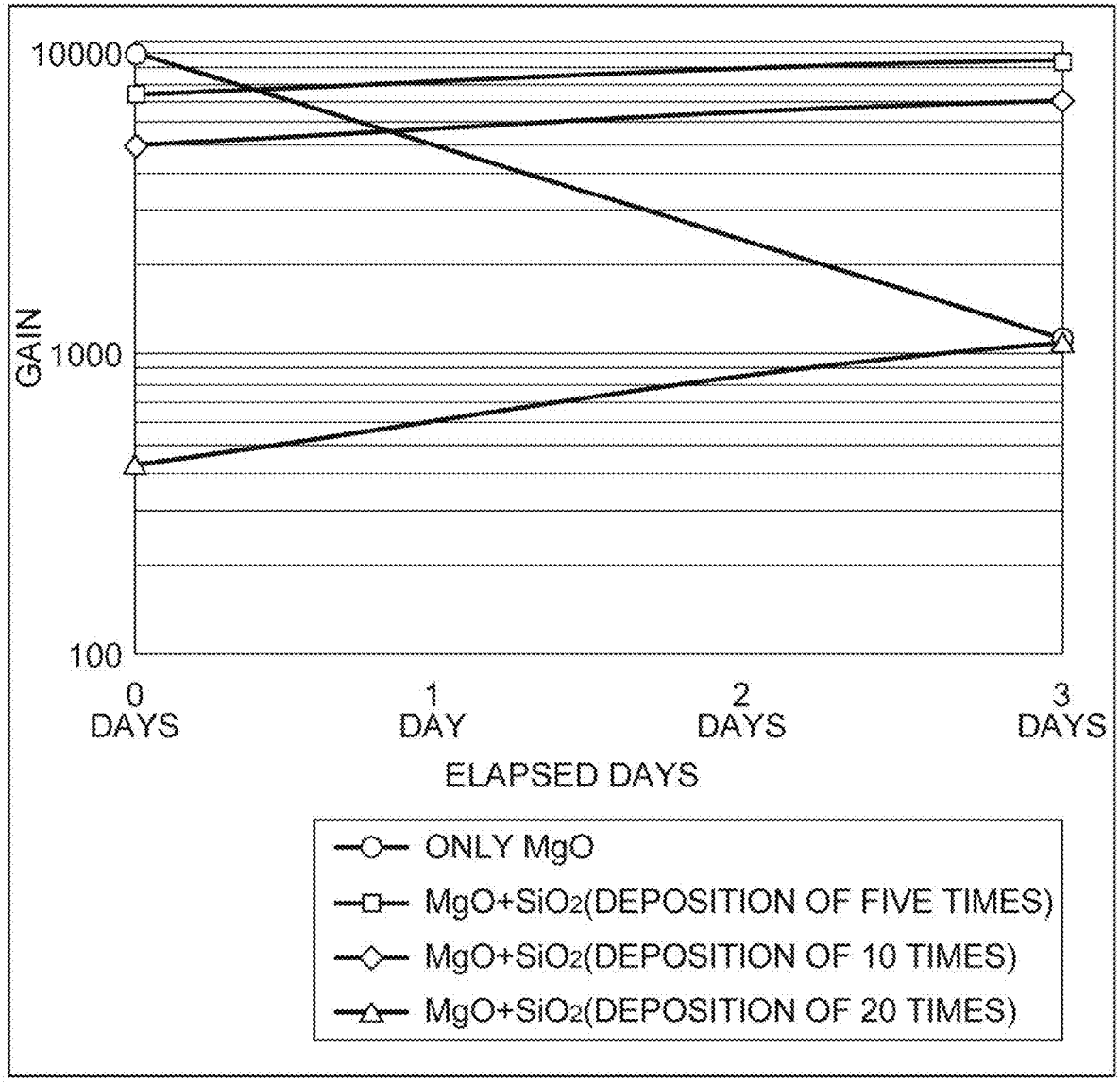
FIG. 13 is a graph illustrating a change in gain over time due to the exposure in the atmosphere.
Figure 14:
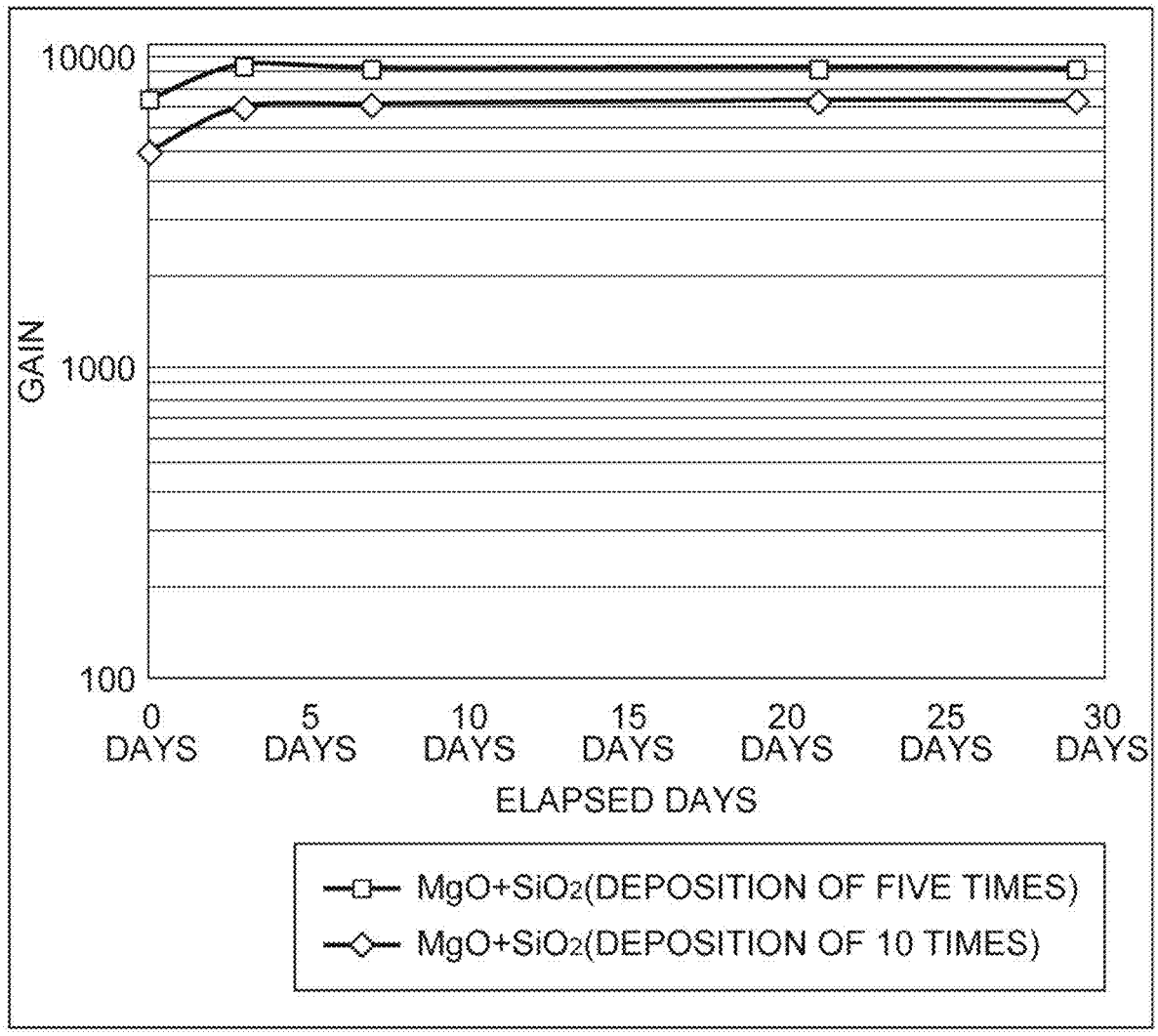
FIG. 14 is another graph illustrating the change in gain over time due to the exposure in the atmosphere.
Figure 15:
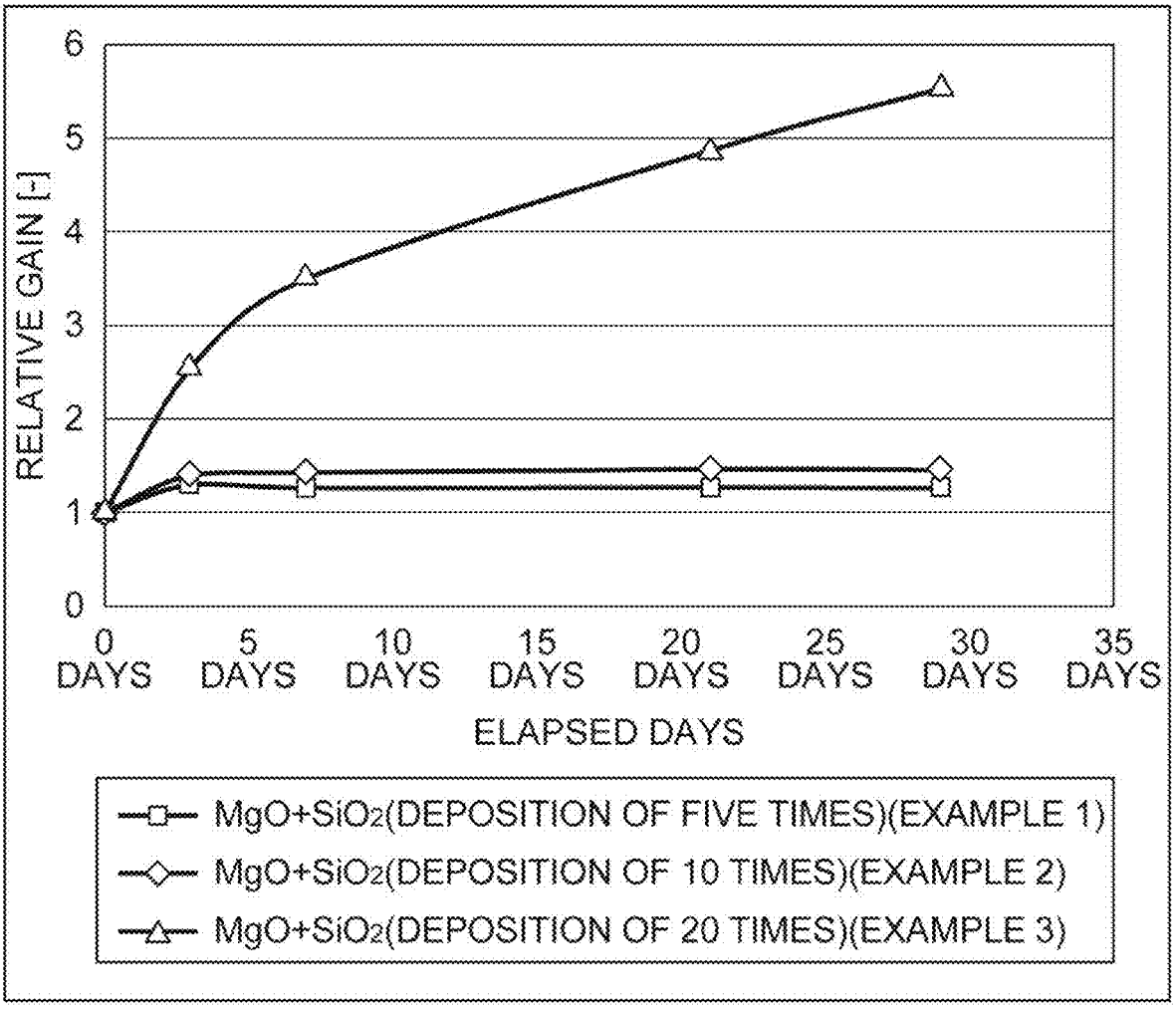
FIG. 15 is a graph illustrating a change in relative gain over time due to the exposure in the atmosphere.

FIG. 13 is a graph illustrating a change in gain over time due to the exposure to the atmosphere. FIG. 14 is another graph illustrating the change in gain over time due to the exposure to the atmosphere. FIG. 15 is a graph illustrating a change in relative gain over time due to the exposure to the atmosphere. FIGS. 13 to 15 illustrate measurement results of the change in gain over time for the microchannel plate 10 exposed to the atmosphere after being stored in $N_2$ until the gain is stabilized after the manufacture thereof. In FIGS. 13 and 14, the gain of the microchannel plate is plotted along the ordinate. In FIG. 15, a relative change rate of the gain (relative gain) with reference to the gain (initial gain) of the microchannel plate 10 immediately before the exposure to the atmosphere (0 days elapsed) is plotted along the ordinate.

In the example of FIG. 13, points indicating the gain when the microchannel plates 10 of the examples 1, 2, and 3 and the microchannel plate of the comparative example are exposed for 0 and 3 days are plotted. In the example of FIG. 14, regarding the examples 1 and 2, the points indicating the gain when the microchannel plate 10 is exposed for 0, 3, 7, 21, and 29 days are plotted. In the example of FIG. 15, regarding the examples 1, 2, and 3, the points indicating the relative gain when the microchannel plate 10 is exposed for 0, 3, 7, 21, and 29 days are plotted.

As illustrated in FIG. 13, in the comparative example in which the protection film 15 made of $SiO_2$ is not provided on the electron emission film 14 made of MgO, the gain decreases from the initial gain when the microchannel plate 10 is exposed to the atmosphere. On the other hand, in the examples 1, 2, and 3 in which the protection film 15 of $SiO_2$ is provided on the electron emission film 14 of MgO, the decrease in gain during the time of the exposure to the atmosphere is suppressed. Instead, in the examples 1, 2, and 3, the gain increases from the initial gain after the exposure to the atmosphere.

As illustrated in FIGS. 14 and 15, it is understood that, in the examples 1 and 2 in which the number of times of deposition of the $SiO_2$ layer is five and 10, respectively, the gain increased after the exposure to the atmosphere is maintained even after the increase. In the examples 1 and 2, the change in gain over time after the exposure to the atmosphere is smaller than that in the example 3. Meanwhile, the change in gain over time is larger in the example 3 than that in the examples 1 and 2, but since the initial gain of the example 3 is smaller than the initial gain of the examples 1 and 2, an absolute value of the gain in the examples 1 and 2 is larger than that in the example 3.

Action and Effect

In the microchannel plate 10, the protection film 15 made of $SiO_2$ is provided on at least a part of the electron emission film 14 made of MgO. Therefore, the reactive site on the outermost surface of MgO may be suppressed, and the electron emission film 14 may be stabilized even in the atmosphere. For example, even in a case of the exposure to the atmosphere, the adhesion of C to the outermost surface of MgO may be suppressed. As a result, it is possible to suppress the deterioration in gain over time during the time of the exposure to the atmosphere. In addition, since the protection film 15 made of $SiO_2$ is made thinner than the electron emission film 14 made of MgO, it is possible to allow the electron emission film 14 made of MgO to serve as the main secondary electron multiplier layer while utilizing the characteristic of MgO having the large secondary electron emission coefficient, thereby efficiently improving the gain. Furthermore, since the electron emission film 14 is made of MgO and the protection film 15 is made of $SiO_2$, the gain may be increased from the initial gain after the exposure to the atmosphere. As described above, according to the microchannel plate 10, a synergetic effect that the adhesion of C to the outermost surface of MgO is suppressed, and the gain is increased from the initial gain is exhibited. Therefore, it is possible to improve the gain while suppressing the deterioration in gain over time.

Meanwhile, although it is conceivable to use diamond as a material of the film of the secondary electron multiplier layer, in this case, it is difficult to form the film for the gap and trench structure of high aspect ratio such as the microchannel plate 10, and this is not realistic. Also, for example, in a case of using an oxide or nitride unstable in the atmosphere as the material of the film of the secondary electron multiplier layer, it is necessary to form a film in vacuum by using equipment such as a glove box, but in the microchannel plate 10, it is not necessary to use the equipment such as the glove box.

In the microchannel plate 10, the protection film 15 is distributed in an island shape on the electron emission film 14. As a result, the protection film 15 may be made sufficiently thin, and it becomes possible to further improve the gain by allowing the electron emission film 14 to more effectively serve as the secondary electron multiplier layer while sufficiently securing the effect of suppressing the deterioration in gain over time.

A thickness of the electron emission film 14 is 10 Å or more when being calculated by using the X-ray fluorescence analysis. Since the electron emission film 14 made of MgO has the thickness of 10 Å or more as described above, the electron emission film 14 may be allowed to effectively serve as the secondary electron multiplier layer.

The substrate 11 is made of the insulating material, and the resistance film 13 is formed between the inner wall surface 12*a* of the channel 12 and the electron emission film 14. As a result, when voltage is applied between the input electrode 16 provided on the input surface 11*a* of the substrate 11 and the output electrode 17 provided on the output surface 11*b* of the substrate 11, a potential gradient is formed by the resistance film 13, and electron multiplication becomes possible.

The electron emission film 14 and the protection film 15 are formed on the input surface 11*a*, the output surface 11*b*, and the side surface 11*e* of the substrate 11, and the input electrode 16 and the output electrode 17 are formed on the protection film 15. Alternatively, an input electrode 16A is formed so as to be in contact with the input surface 11*a* of the substrate 11 and an output electrode 17A is formed so as to be in contact with the output surface 11*b*, and the electron emission film 14 and the protection film 15 are formed on the input electrode 16A and the output electrode 17A, and the input surface 11*a*, the output surface 11*b*, and the side surface 11*e* of the substrate 11. In such configurations, the gas emission from the substrate 11 may be effectively suppressed in a case where the substrate 11 is made of a material which emits a large amount of gas, for example, since the electron emission film 14 and the protection film 15 cover the input surface 11*a*, the output surface 11*b*, and the side surface 11*c* of the substrate 11.

The resistance film 13, the electron emission film 14, and the protection film 15 are formed on the input surface 11*a*, the output surface 11*b*, and the side surface 11*c* of the substrate 11, and the input electrode 16 and the output electrode 17 are formed on the protection film 15. Alternatively, the input electrode 16A is formed so as to be in contact with the input surface 11*a* of the substrate 11 and the output electrode 17A is formed so as to be in contact with the output surface 11*b*, and the resistance film 13, the electron emission film 14, and the protection film 15 are formed on the input surface 11*a*, the output surface 11*b*, and the side surface 11*c* of the substrate 11. In such configurations, the gas emission from the substrate 11 may be effectively suppressed in the case where the substrate 11 is made of the material which emits a large amount of gas, for example, since not only the electron emission film 14 and the protection film 15 but also the resistance film 13 cover the input surface 11*a*, the output surface 11*b*, and the side surface 11*c* of the substrate 11.

The electron emission film 14 and the protection film 15 are layers formed by the atomic layer deposition. As a result, since the electron emission film 14 and the protection film 15 may be formed at the atomic layer level, the film in which the defect such as the pinhole is suppressed with the uniform film quality may be formed. A mixed film containing a plurality of metal oxides (for example, MgO and $SiO_2$) may be formed in the order of angstroms. For example, it is possible to form the film for the gap and the trench structure with the high aspect ratio such as the microchannel plate 10.

Meanwhile, when the protection film 15 made of $SiO_2$ is provided on at least a part of the electron emission film 14 made of MgO, C (carbon) derived from $H_2O$ and $CO_2$ present in the atmosphere is not likely to be adhered to the outermost surface of MgO as compared to a case where the protection film 15 is not provided on the electron emission film 14. Therefore, the decrease in gain caused by C adhering to the outermost surface of MgO after the exposure to the atmosphere is less likely to occur. In addition, since the protection film 15 is made of $SiO_2$, even if C adheres to the protection film 15 after the exposure to the atmosphere, the decrease in gain such as that when C adheres to the outermost surface of MgO does not occur, but the gain increases from the initial gain instead. That is, the protection film 15 which is the second film is a film to which C (carbon) due to $H_2O$ and $CO_2$ present in the atmosphere is less likely to adhere than the electron emission film 14 which is the first film, the film that increases the gain from the initial gain while suppressing the decrease in gain after the exposure to the atmosphere.

Variation of Microchannel Plate 10

Although the substrate 11 is made of the insulating material in the above-described embodiment, the substrate 11 may also be made of a semiconductor material (resistant material) such as Si. In this case, it is not necessary to provide the resistance film 13 on the inner wall surface 12*a* of the channel 12, and the electron emission film 14 may also be formed directly on the substrate 11 (formed at least on the inner wall surface 12*a*). Even in such a mode, an action and an effect similar to those of the above-described embodiment may be obtained. Since a manufacturing process of the resistance film 13 may be omitted, a manufacturing cost may be decreased.

Second Embodiment

Figure 16:
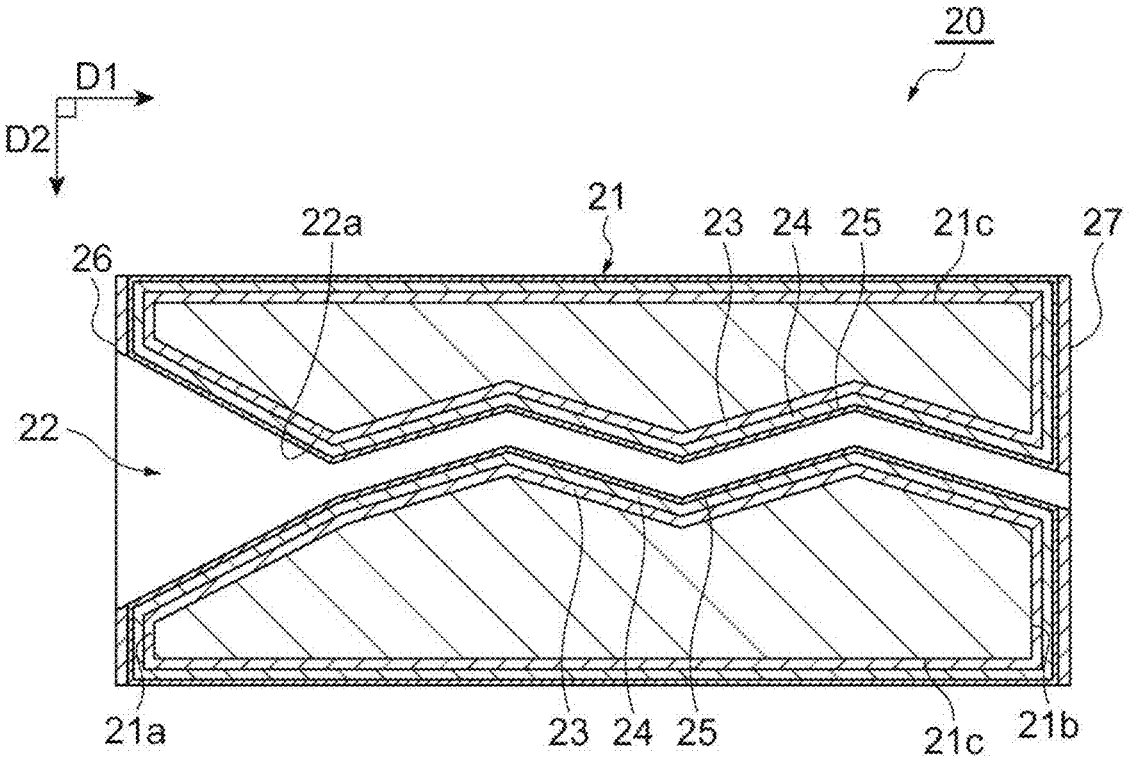
FIG. 16 is a cross-sectional view of an electron multiplier according to a second embodiment.

FIG. 16 is a cross-sectional view of an electron multiplier according to a second embodiment. As illustrated in FIG. 16, an electron multiplier 20 is a dynode structure having a function to multiply electrons. The electron multiplier 20 includes a main body 21 including one end face (front surface) 21*a* and the other end face (rear surface) 21*b*. The main body 21 has a rectangular parallelepiped shape and extends in a first direction D1. The main body 21 is made of an insulating material such as ceramic, for example. Meanwhile, the electron multiplier 20 is not limited to this example, and may also be a dynode structure of a so-called single channel dynode (for example, a channeltron and the like).

A channel 22 is formed in the main body 21. The channel 22 opens on one end face 21*a* and the other end face 21*b* of the main body 21 in the first direction D1. That is, the channel 22 penetrates from the one end face 21*a* to the other end face 21*b* of the main body 21. A side of the one end face 21*a* of the channel 22 has a tapered shape expanding toward the one end face 21*a*. The channel 22 extends in a wave shape such that bending is repeated in a second direction D2 from the one end face 21*a* side to the other end face 21*b*. In the channel 22, electrons are incident and secondary electrons are emitted according to the incident electrons on the one end face 21*a* side, and the secondary electrons are emitted from the other end face 21*b* side.

A resistance film 23, an electron emission film (first film) 24, a protection film (second film) 25, an input electrode (electrode layer) 26, and an output electrode (electrode layer) 27 are formed on the main body 21 as functional films.

The resistance film 23 is provided on an inner wall surface 22*a* of the channel 22. The resistance film 23 is provided so as to cover an outer surface of the main body 21. Specifically, the resistance film 23 is formed at least on the inner wall surface 22*a* of the channel 22. The resistance film 23 is formed on the one end face 21*a* except for the opening of the channel 22. The resistance film 23 is formed on the other end face 21*b* except for the opening of the channel 22. The resistance film 23 is formed so as to cover a side surface 21*c* of the main body 21. Since the resistance film 23 covers the one end face 21*a*, the other end face 21*b*, the inner wall surface 22*a* of the channel 22, and the side surface 21*c* in the above-described manner, gas emission from the main body 21 may be effectively suppressed in a case where the main body 21 is made of a material such as lead glass which emits a large amount of gas during operation, for example. The resistance film 23 has a predetermined resistance value suitable for electron multiplication in the electron multiplier 20. The resistance film 23 is formed, for example, by using atomic layer deposition in a manner similar to that of the resistance film 13. The resistance film 23 is formed, for example, by repeating a cycle of depositing an $Al_2O_3$ layer and a cycle of depositing a Pt layer by the atomic layer deposition a plurality of times respectively. A thickness of the resistance film 23 is, for example, about 200 Å to 700 Å.

The electron emission film 24 is the first film provided on the inner wall surface 22*a* of the channel 22. The electron emission film 24 is provided so as to cover the resistance film 23. Specifically, the electron emission film 24 is formed so as to be in contact with the resistance film 23 on at least the inner wall surface 22*a* of the channel 22. The electron emission film 24 is formed so as to be in contact with the resistance film 23 on the one end face 21*a* except for the opening of the channel 22. The electron emission film 24 is formed so as to be in contact with the resistance film 23 on the other end face 21*b* except for the opening of the channel 22. The electron emission film 24 is formed so as to cover the side surface 21*c* of the main body 21. Since the electron emission film 24 covers the one end face 21*a*, the other end face 21*b*, the inner wall surface 22*a* of the channel 22, and the side surface 21*c* in the above-described manner, the gas emission from the main body 21 may be effectively suppressed in the case where the main body 21 is made of the material such as lead glass which emits a large amount of gas during operation, for example. When electrons accelerated by an electric field (to be described later) in the channel 22 collide with the electron emission film 24, this emits the secondary electrons accordingly and multiplies the electrons. The electron emission film 24 is made of MgO. The electron emission film 24 is formed, for example, by using the atomic layer deposition in a manner similar to that of the electron emission film 14. The electron emission film 24 is formed, for example, by repeating a cycle of depositing a MgO layer by the atomic layer deposition a plurality of times. A thickness of the electron emission film 24 is 10 Å or more in a case where the thickness of the electron emission film 24 is calculated by using X-ray fluorescence analysis. The thickness of the electron emission film 24 may also be, for example, about 30 Å to 50 Å.

The protection film 25 is the second film provided on at least a part of the electron emission film 24 (first film). The protection film 25 is formed so as to be in contact with the electron emission film 24 on at least a part of the inner wall surface 22*a* of the channel 22. The protection film 25 is formed so as to be in contact with the electron emission film 24 on at least a part of one end face 21*a* except for the opening of the channel 22. The protection film 25 is formed so as to be in contact with the electron emission film 24 on at least a part of the other end face 21*b* except for the opening of the channel 22. The protection film 25 is formed so as to be in contact with at least a part of the side surface 21*c* of the main body 21. The protection film 25 suppresses deterioration in gain over time of secondary electron emission when the electron multiplier 20 is exposed to the atmosphere, and increases the gain from initial gain in cooperation with the electron emission film 24.

The protection film 25 is made of $SiO_2$. The protection film 25 is formed, for example, by using the atomic layer deposition in a manner similar to that of the protection film 15. The protection film 25 is formed, for example, by repeating a cycle of depositing the $SiO_2$ layer by the atomic layer deposition a plurality of times. A thickness of the protection film 25 is, for example, a half or less of that of the electron emission film 24. Preferably, the thickness of the protection film 25 is, for example, 10 Å or less. More preferably, the thickness of the protection film 25 is, for example, about 5 Å to 10 Å. That is, the protection film 25 is thinner than the electron emission film 24.

The input electrode 26 and the output electrode 27 are provided on the one end face 21*a* and the other end face 21*b* of the main body 21, respectively. Specifically, the input electrode 26 is formed so as to be in contact with the protection film 25 on the one end face 21*a* except for the opening of the channel 22. The output electrode 27 is formed so as to be in contact with the protection film 25 on the other end face 21*b* except for the opening of the channel 22. The input electrode 26 and the output electrode 27 are formed by evaporating, for example, a metal film containing nickel-based metal and the like. By using the evaporation, the input electrode 26 is formed on the one end face 21*a* except for the opening of the channel 22, and the output electrode 27 is formed on the other end face 21*b* except for the opening of the channel 22. Thicknesses of the input electrode 26 and the output electrode 27 are, for example, about 1000 Å. Voltage potential which is lower in the output electrode 27 than in the input electrode 26 is applied to the input electrode 26 and the output electrode 27 such that an electric field directed from the input electrode 26 to the output electrode 27 is generated in the channel 22.

Herein, in order to specify structures or characteristics of the resistance film 23, the electron emission film 24, and the protection film 25 (hereinafter referred to as "ALD film" in this paragraph) fanned by the atomic layer deposition, it is necessary to analyze a surface state of the ALD film. However, the electron multiplier 20 also is a structure having a high aspect ratio similar to a microchannel plate 10, and no device capable of specifically analyzing the surface state of the ALD film formed on the electron multiplier 20 is currently known, so that it is difficult to analyze a laminated structure itself of the ALD film. As described above, it is technically impossible or impractical to analyze the structure or the characteristic of the ALD film at the time of filing, so that there is a circumstance that it is impossible or impractical to directly specify the ALD film by its structure or characteristic in the electron multiplier 20.

Next, a method of manufacturing the electron multiplier 20 is described. As illustrated in FIG. 2, the method of manufacturing the electron multiplier 20 is such that the resistance film 23 is formed on the main body 21 at steps S1 to S3, the electron emission film 24 is formed on the resistance film 23 at step S4, and thereafter, the protection film 25 is formed on at least a part of the electron emission film 24 at step 55. Since the specific description is similar to that of the method of manufacturing the microchannel plate 10 described above, this is omitted. Meanwhile, it is also possible to manufacture an electron multiplier 20A by forming the resistance film 23, the electron emission film 24, and the protection film 25 at steps S1 to S5 described above after an input electrode 26A and an output electrode 27A are formed on the main body 21 in advance by evaporation and the like (refer to FIG. 17(*b*)). In this case, the input electrode 26A is foamed so as to be in contact with the one end face 21*a* of the main body 21 and the output electrode 27A is formed so as to be in contact with the other end face 21*b*, and the resistance film 23, the electron emission film 24, and the protection film 25 are sequentially fainted so as to cover the input electrode 26A and the output electrode 27A. A range in which the resistance film 23, the electron emission film 24, and the protection film 25 are formed is as already described above, the range which covers the one end face 21*a*, the other end face 21*b*, the inner wall surface 22*a*, and the side surface 21*c*.

In the electron multiplier 20, by providing the protection film 25 made of $SiO_2$ on at least a part of the electron emission film 24 made of MgO, not only the deterioration in gain over time in a case of exposure to the atmosphere is suppressed but also the gain increases from initial gain immediately before the exposure to the atmosphere after the exposure to the atmosphere.

Similar to the protection film 15, the protection film 25 is distributed in an island shape (island shape) on the electron emission film 24. Herein, a state "distributed in an island shape" includes a state in which $SiO_2$ forming the protection film 25 is scattered (discretely adsorbed) on MgO forming the electron emission film 24. The state "distributed in an island shape" includes a state in which the structure of the protection film 25 is a deposited structure in which a plurality of islands is formed on the outermost surface of MgO in a side view. The state "distributed in an island shape" includes a state in which $SiO_2$ forming the protection film 25 is partially absent on MgO forming the electron emission film 24. The state "distributed in an island shape" includes a state in which the structure of the protection film 25 is partially opened. The state "distributed in an island shape" includes a state in which $SiO_2$ forming the protection film 25 is entirely absent on MgO forming the electron emission film 24. The state "distributed in an island shape" includes a state in which the structure of the protection film 25 is not a continuous layer. Herein, the "continuous layer" of the protection film 25 refers to a structure in which the structure of the protection film 25 is not opened and covers an entire (entire surface of) the electron emission film 24.

Meanwhile, the protection film 25 may be provided to cover the entire electron emission film 24 and may be distributed in a continuous layer. In this case, the protection film 25 is formed so as to be in contact with the electron emission film 24 on the inner wall surface 22*a* of the channel 22. The protection film 25 is formed so as to be in contact with the electron emission film 24 on one end face 21*a* except for the opening of the channel 22. The protection film 25 is formed so as to be in contact with the electron emission film 24 on the other end face 21*b* except for the opening of the channel 22. The protection film 25 is formed so as to cover the side surface 21*c* of the main body 21.

As a result, the electron multiplier 20 has a characteristic similar to that of the microchannel plate 10 as described above.

Specifically, since the protection film 25 made of $SiO_2$ is provided on at least a part of the electron emission film 24 made of MgO, there is a characteristic that C (carbon) derived from $H_2O$ and $CO_2$ present in the atmosphere is not likely to be adhered to the outermost surface of MgO.

In the electron multiplier 20 also, it is considered that an effect is easily exhibited as the thickness of the protection film 25 increases, wherein the effect is that the emission of the secondary electrons from the electron emission film 24 is blocked by the protection film 25 which does not substantially emit the secondary electrons. Therefore, in the electron multiplier 20, it is considered that the characteristic of MgO having a large secondary electron emission coefficient may be utilized and the gain may be efficiently improved when the protection film 25 is made thin (for example, less than 10 Å) and the electron emission film 24 made of MgO is allowed to serve as the main secondary electron multiplier layer as compared to a case where the protection film 25 is made thicker (for example, 10 Å or more) and the secondary electron emission coefficient of the protection film 25 is increased. Therefore, in the electron multiplier 20, the thickness of the protection film 25 may be less than 10 Å. Especially, in the electron multiplier 20, the thickness of the protection film 25 may be 5 Å to 10 Å. By optimizing the thickness of the $SiO_2$ layer to be adsorbed in this manner, the electron emission film 24 made of MgO may be allowed to effectively serve as the secondary electron multiplier layer to maintain the high gain while sufficiently securing the effect of suppressing the deterioration in gain over time.

In the electron multiplier 20 also, when the protection film 25 made of $SiO_2$ is provided on at least a part of the electron emission film 24 made of MgO, the deterioration in gain during the time of the exposure to the atmosphere is suppressed. Instead, in this case, the gain increases from the initial gain immediately before the exposure to the atmosphere after the exposure to the atmosphere. Also, when the number of times of deposition of the $SiO_2$ layer is five and 10, respectively, the gain increased after the exposure to the atmosphere is maintained even after the increase.

Action and Effect

The electron multiplier 20 configured in the above-described manner exhibits an action and an effect similar to those of the microchannel plate 10. That is, the protection film 25 made of $SiO_2$ is provided on at least a part of the electron emission film 24 made of MgO. Therefore, the reactive site on the outermost surface of MgO may be suppressed, and the electron emission film 14 may be stabilized even in the atmosphere. For example, even in a case of the exposure to the atmosphere, the adhesion of C to the outermost surface of MgO may be suppressed. As a result, it is possible to suppress the deterioration in gain over time during the time of the exposure to the atmosphere. In addition, since the protection film 25 made of $SiO_2$ is made thinner than the electron emission film 24 made of MgO, it is possible to allow the electron emission film 24 made of MgO to serve as the main secondary electron multiplier layer while utilizing the characteristic of MgO having the large secondary electron emission coefficient, thereby efficiently improving the gain. Furthermore, since the electron emission film 24 is made of MgO and the protection film 25 is made of $SiO_2$, the gain may be increased from the initial gain after the exposure to the atmosphere. In this manner, according to the electron multiplier 20, a synergetic effect that the adhesion of C and O to the outermost surface of MgO is suppressed, and the gain is increased from the initial gain is exhibited. Therefore, it is possible to improve the gain while suppressing the deterioration in gain over time.

In the electron multiplier 20, the protection film 25 is distributed in an island shape on the electron emission film 24. As a result, the protection film 25 may be made sufficiently thin, and it becomes possible to further improve the gain by allowing the electron emission film 24 to more effectively serve as the secondary electron multiplier layer while sufficiently securing the effect of suppressing the deterioration in gain over time.

A thickness of the electron emission film 24 is 10 Å or more when being calculated by using the X-ray fluorescence analysis. Since the electron emission film 24 made of MgO has the thickness of 10 Å or more as described above, the electron emission film 24 may be allowed to effectively serve as the secondary electron multiplier layer.

The main body 21 is made of an insulating material, and the resistance film 23 is formed between the main body 21 (inner wall surface 22*a* of the channel 22) and the electron emission film 24. As a result, when voltage is applied between the input electrode 26 provided on the one end face 21*a* of the main body 21 and the output electrode 27 provided on the other end face 21*b* of the main body 21, a potential gradient is formed by the resistance film 23, and electron multiplication becomes possible.

The electron emission film 24 and the protection film 25 are formed on the one end face 21*a*, the other end face 21*b*, and the side surface 21*c* of the main body 21, and the input electrode 26 and the output electrode 27 are formed on the protection film 25. Alternatively, the input electrode 26A is formed so as to be in contact with the one end face 21*a* of the main body 21 and the output electrode 27A is formed so as to be in contact with the other end face 21*b*, and the electron emission film 24 and the protection film 25 are formed on the input electrode 26A and the output electrode 27A, and the one end face 21*a*, the other end face 21*b*, and the side surface 21*c* of the main body 21. In such configurations, the gas emission from the main body 21 may be effectively suppressed in a case where the main body 21 is made of a material which emits a large amount of gas, for example, since the electron emission film 24 and the protection film 25 cover the one end face 21*a*, the other end face 21*b*, and the side surface 21*c* of the main body 21.

The resistance film 23, the electron emission film 24, and the protection film 25 are formed on the one end face 21*a*, the other end face 21*b*, and the side surface 21*c* of the main body 21, and the input electrode 26 and the output electrode 27 are formed on the protection film 25. Alternatively, the input electrode 26A is formed so as to be in contact with the one end face 21*a* of the main body 21 and the output electrode 27A is formed so as to be in contact with the other end face 21*b*, and the resistance film 23, the electron emission film 24, and the protection film 25 are formed on the one end face 21*a*, the other end face 21*b*, and the side surface 21*c* of the main body 21. In such configurations, the gas emission from the main body 21 may be effectively suppressed in the case where the main body 21 is made of the material which emits a large amount of gas, for example, since not only the electron emission film 24 and the protection film 25 but also the resistance film 23 cover the one end face 21*a*, the other end face 21*b*, and the side surface 21*c* of the main body 21.

The electron emission film 24 and the protection film 25 are layers formed by the atomic layer deposition. As a result, since the electron emission film 24 and the protection film 25 may be formed at an atomic layer level, the film in which a defect such as a pinhole is suppressed with a uniform film quality may be formed. A mixed film containing a plurality of metal oxides (for example, MgO and $SiO_2$) may be formed in the order of angstroms. For example, it is possible to form a film for a gap and a trench structure with a high aspect ratio such as the electron multiplier 20.

Meanwhile, when the protection film 25 made of $SiO_2$ is provided on at least a part of the electron emission film 24 made of MgO, C (carbon) derived from $H_2O$ and $CO_2$ present in the atmosphere is not likely to be adhered to the outermost surface of MgO as compared to a case where the protection film 25 is not provided on the electron emission film 24. Therefore, the decrease in gain caused by C adhering to the outermost surface of MgO after the exposure to the atmosphere is less likely to occur. In addition, since the protection film 25 is made of $SiO_2$, even if C adheres to the protection film 25 after the exposure to the atmosphere, the decrease in gain such as that when C adheres to the outermost surface of MgO does not occur, but the gain increases from the initial gain instead. That is, the protection film 25 which is the second film is a film to which C (carbon) due to $H_2O$ and $CO_2$ present in the atmosphere is less likely to adhere than the electron emission film 24 which is the first film, the film that increases the gain from the initial gain while suppressing the decrease in gain after the exposure to the atmosphere.

Variation of Electron Multiplier 20

Although the main body 21 is made of the insulating material in the above-described embodiment, the main body 21 may also be made of a semiconductor material (resistant material) such as Si. In this case, it is not necessary to provide the resistance film 23 on the main body 21, and the electron emission film 24 may also be formed directly on the main body 21 (formed at least on the inner wall surface 22*a*). Even in such a mode, an action and an effect similar to those of the above-described embodiment may be obtained. Since the manufacturing process of the resistance film 23 may be omitted, the manufacturing cost may be reduced.

INDUSTRIAL APPLICABILITY

According to one aspect of the present invention, it is possible to provide a microchannel plate and an electron multiplier capable of improving the gain while suppressing deterioration in gain over time.

REFERENCE SIGNS LIST

10 Microchannel plate
11 Substrate
11*a* Input surface (front surface)
11*b* Output side (rear surface)
12 Channel
12*a* Inner wall surface
13 Resistance film
14 Electron emission film (first film)
15 Protection film (second film)
16 Input electrode (electrode layer)
17 Output electrode (electrode layer)
20 Electron multiplier
21 Main body
21*a* One end face (front face)
21*b* Other end face (rear face)
22 Channel
22*a* Inner wall surface
23 Resistance film
24 Electron emission film (first film)
25 Protection film (second film)
26 Input electrode (electrode layer)
27 Output electrode (electrode layer)

The invention claimed is:

1. A microchannel plate comprising:
a substrate including a front surface, a rear surface, and a side surface;
a plurality of channels penetrating from the front surface to the rear surface of the substrate;
a first film provided on at least an inner wall surface of the channel;
a second film provided on at least a part of the first film; and
electrode layers provided on the front surface and the rear surface of the substrate,
wherein the first film is made of MgO,
the second film is made of $SiO_2$, and
the second film is thinner than the first film.

2. The microchannel plate according to claim 1,
wherein the second film is distributed in an island shape on the first film.

3. The microchannel plate according to claim 1,
wherein a thickness of the first film is 10 Å or more when being calculated by using X-ray fluorescence analysis.

4. The microchannel plate according to claim 1,
wherein the substrate is made of an insulating material, and
a resistance film is formed between the inner wall surface of the channel and the first film.

5. The microchannel plate according to claim 1,
wherein the substrate is made of a resistant material.

6. The microchannel plate according to claim 1,
wherein the first film and the second film are formed on the front surface, the rear surface, and the side surface of the substrate, and
the electrode layers are formed on the second film.

7. The microchannel plate according to claim 1,
wherein the electrode layers are formed so as to be in contact with the front surface and the rear surface of the substrate, and
the first film and the second film are formed on the electrode layers, and the front surface, the rear surface, and the side surface of the substrate.

8. The microchannel plate according to claim 4,
wherein the resistance film, the first film, and the second film are formed on the front surface, the rear surface, and the side surface of the substrate, and
the electrode layers are formed on the second film.

9. The microchannel plate according to claim 4,
wherein the electrode layers are formed so as to be in contact with the front surface and the rear surface of the substrate, and
the resistance film, the first film, and the second film are formed on the front surface, the rear surface, and the side surface of the substrate.

10. The microchannel plate according to claim 1,
wherein the first film and the second film are layers formed by atomic layer deposition.

11. An electron multiplier comprising:
a main body including a front surface, a rear surface, and a side surface;
a channel penetrating from the front surface to the rear surface of the main body;
a first film provided on at least an inner wall surface of the channel;

a second film provided on at least a part of the first film; and electrode layers provided on the front surface and the rear surface of the main body, wherein the first film is made of MgO, the second film is made of $SiO_2$, and the second film is thinner than the first film.

12. The electron multiplier according to claim 11, wherein the second film is distributed in an island shape on the first film.

13. The electron multiplier according to claim 11, wherein a thickness of the first film is 10 Å or more when being calculated by using X-ray fluorescence analysis.

14. The electron multiplier according to claim 11, wherein the main body is made of an insulating material, and a resistance film is formed between the inner wall surface of the channel and the first film.

15. The electron multiplier according to claim 11, wherein the main body is made of a resistant material.

16. The electron multiplier according to claim 11, wherein the first film and the second film are formed on the front surface, the rear surface, and the side surface of the main body, and the electrode layers are formed on the second film.

17. The electron multiplier according to claim 11, wherein the electrode layers are formed so as to be in contact with the front surface and the rear surface of the main body, and the first film and the second film are formed on the electrode layers, and the front surface, the rear surface, and the side surface of the main body.

18. The electron multiplier according to claim 14, wherein the resistance film, the first film, and the second film are formed on the front surface, the rear surface, and the side surface of the main body, and the electrode layers are formed on the second film.

19. The electron multiplier according to claim 14, wherein the electrode layers are formed so as to be in contact with the front surface and the rear surface of the main body, and the resistance film, the first film, and the second film are formed on the front surface, the rear surface, and the side surface of the main body.

20. The electron multiplier according to claim 11, wherein the first film and the second film are layers formed by atomic layer deposition.

21. The microchannel plate according to claim 4, wherein the resistance film is formed by laminating an $Al_2O_3$ layer and a Pt layer alternately.

22. The microchannel plate according to claim 4, wherein the first film is formed on an $Al_2O_3$ layer.

23. The microchannel plate according to claim 4, wherein the first film is formed on a Pt layer.

24. The electron multiplier according to claim 14, wherein the resistance film is formed by laminating an $Al_2O_3$ layer and a Pt layer alternately.

25. The electron multiplier according to claim 14, wherein the first film is formed on an $Al_2O_3$ layer.

26. The electron multiplier according to claim 14, wherein the first film is formed on a Pt layer.

* * * * *